US006409142B1

(12) United States Patent
Kariya et al.

(10) Patent No.: US 6,409,142 B1
(45) Date of Patent: Jun. 25, 2002

(54) PIPE BREAKAGE CONTROL VALVE DEVICE

(75) Inventors: Masao Kariya, Tsuchiura; Genroku Sugiyama, Ibaraki-ken, both of (JP)

(73) Assignee: Hitachi Construction Machinery Co. Ltd., Tokyo (JP)

( * ) Notice: Subject to any disclaimer, the term of this patent is extended or adjusted under 35 U.S.C. 154(b) by 0 days.

(21) Appl. No.: 09/857,446

(22) PCT Filed: Oct. 18, 2000

(86) PCT No.: PCT/JP00/07210

§ 371 (c)(1),
(2), (4) Date: Jun. 4, 2001

(87) PCT Pub. No.: WO01/29430

PCT Pub. Date: Apr. 26, 2001

(30) Foreign Application Priority Data

Oct. 20, 1999 (JP) ..... 11-298388

(51) Int. Cl.[7] ..... F16K 31/12
(52) U.S. Cl. ..... 251/44; 251/35; 137/460
(58) Field of Search ..... 251/44, 35; 137/460

(56) References Cited

U.S. PATENT DOCUMENTS 4,471,797 A * 9/1984 Cass et al. ..... 137/460
4,471,806 A * 9/1984 Strock ..... 137/460
4,732,190 A * 3/1988 Polselli ..... 137/460
4,779,836 A 10/1988 Marklund
4,905,959 A * 3/1990 Andersson ..... 251/35
5,137,254 A * 8/1992 Aardema et al. ..... 251/35
5,178,358 A * 1/1993 Schwelm ..... 251/44
5,207,059 A 5/1993 Schexnayder
5,645,263 A 7/1997 Aardema

FOREIGN PATENT DOCUMENTS

| | | |
|---|---|---|
| JP | 63-502982 | 11/1987 |
| JP | 2-91201 | 7/1990 |
| JP | 3-249411 | 11/1991 |
| JP | 6-50302 | 2/1994 |
| JP | 7-503053 | 3/1995 |
| JP | 952 358 | 10/1999 |
| JP | 11-303810 | 11/1999 |
| WO | WO9314322 | 7/1993 |
| WO | WO8604964 | 8/1996 |

* cited by examiner

*Primary Examiner*—Henry C. Yuen
*Assistant Examiner*—John Bastianelli
(74) *Attorney, Agent, or Firm*—Mattingly, Stanger & Malur, P.C.

(57) ABSTRACT

An input/output port 1 of a hose rupture control valve unit 100 is attached to a bottom port of a hydraulic cylinder 102, and an input/output port 2 is connected to one of actuator ports of a control valve 103 via an actuator line 105. The valve unit comprises a poppet valve body 5 serving as a main valve, a first spool valve body 6 serving as a pilot valve operated with a pilot pressure supplied as an external signal and having a pilot variable throttle portion 6*a* to operate the poppet valve body 5, a second spool valve body 50 operated with a pilot pressure and having a sub-variable throttle portion 50*a* to control a sub-flow rate, and a small relief valve 7 having the function of an overload relief valve.

6 Claims, 15 Drawing Sheets

COMPARATIVE EXAMPLE
(INVENTION OF EARLIER FILED APPLICATION)

PRIOR ART

PRIOR ART

PRIOR ART

PIPE BREAKAGE CONTROL VALVE DEVICE

TECHNICAL FIELD

The present invention relates to a hose rupture control valve unit (hose rupture valve), which is provided in a hydraulic machine, such as a hydraulic excavator, for preventing a drop of a load upon rupture of a cylinder hose.

BACKGROUND ART

In a hydraulic machine, e.g., a hydraulic excavator, there is a need for preventing a drop of a load even if a hose or steel pipe for supplying a hydraulic fluid to a hydraulic cylinder, serving as an actuator for driving the load, e.g., an arm, should be ruptured. To meet such a need, a hose rupture control valve unit, also called a hose rupture valve, is provided in the hydraulic machine. FIG. 14 is a hydraulic circuit diagram showing a typical conventional hose rupture control valve unit, and FIG. 15 is a sectional view of the hose rupture control valve unit.

Referring to FIGS. 14 and 15, a hose rupture control valve unit 200 comprises a housing 204 provided with two input/output ports 201, 202 and a reservoir port 203. The input/output port 201 is directly attached to a bottom port of a hydraulic cylinder 102, the input/output port 202 is connected to one of actuator ports of a control valve 103 via a hydraulic hose 105, and the reservoir port 203 is connected to a reservoir 109 via a drain hose 205. Within the housing 204, there are provided a main spool 211 operated with a pilot pressure supplied as an external signal from a manual pilot valve 108, a check valve 212 for fluid supply, a poppet valve body 214 controlled by a pilot portion 213 which is provided on the main spool 211, and an overload relief valve 215 for releasing an abnormal pressure.

In the conventional hose rupture control valve unit 200 having the above-described construction, a hydraulic fluid is supplied to the bottom side of the hydraulic cylinder 102 by supplying the hydraulic fluid from the control valve 103 to the bottom side through the fluid-supply check valve 212 in the valve unit 200. Also, the hydraulic fluid is discharged from the bottom side of the hydraulic cylinder 102 by operating the main spool 211 of the valve unit 200 with the pilot pressure, as an external signal, so as to first open the poppet valve body 214 controlled by the pilot portion 213 which is provided on the main spool 211, and to then open a variable throttle portion 211*a* also provided on the main spool 211, thereby draining the hydraulic fluid to the reservoir 109 while controlling a flow rate of the hydraulic fluid.

The poppet valve body 214 is provided in series with the main spool 211, and has the function (load check function) of reducing the amount of leakage in a condition of holding the load pressure on the bottom side of the hydraulic cylinder 102.

The overload relief valve 215 functions to drain the hydraulic fluid and prevent hose rupture in case that an excessive external force acts upon the hydraulic cylinder 102 and the hydraulic pressure supplied to the bottom side of the hydraulic cylinder 102 is brought into a high-pressure level.

Also, if the hydraulic hose 105 leading from the control valve 103 to the input/output port 202 should be ruptured, the check valve 212 and the poppet valve body 214 are closed to prevent a drop of a load supported by the hydraulic cylinder 102. In such an event, by operating the main spool 211 with the pilot pressure from the manual pilot valve 108 and adjusting an opening area of the variable throttle portion 211*a*, it is possible to slowly contract the hydraulic cylinder 102 under action of the weight of the load itself and to move the load to a safety position.

Numerals 107*a* and 107*b* denote main relief valves for limiting a maximum pressure in the circuit.

Further, JP, A 3-249411 discloses a hose rupture control valve unit utilizing a proportional seat valve to reduce an overall size of the valve unit. FIG. 16 shows the disclosed hose rupture control unit.

Referring to FIG. 16, a hose rupture control valve unit 300 comprises a housing 323 provided with an input port 320, a work port 321 and a reservoir port 322. The input port 320 is connected to one of actuator ports of a control valve 103, the work port 321 is connected to a bottom port of a hydraulic cylinder 102, and the reservoir port 322 is connected to a reservoir 109 via a drain hose 205. Within the housing 323, there are provided a check valve 324 for fluid supply, a proportional seat valve 325, an overload relief valve 326, and a pilot valve 340. The pilot valve 340 is operated with a pilot pressure supplied as an external signal from a manual pilot valve 108 (see FIG. 14), and the proportional seat valve 325 is operated with the operation of the pilot valve 340. The overload relief valve 326 is incorporated in the proportional seat valve 325.

A hydraulic fluid to the bottom side of the hydraulic cylinder 102 is supplied by supplying the hydraulic fluid from the control valve 103 to the bottom side through the fluid-supply check valve 324 in the valve unit 300. Also, the hydraulic fluid is discharged from the bottom side of the hydraulic cylinder 102 by operating the pilot valve 340 of the valve unit 300 with the pilot pressure, as an external signal, to open the proportional seat valve 325, thereby draining the hydraulic fluid to the reservoir 109 while controlling a flow rate of the hydraulic fluid. The proportional seat valve 325 has the function (load check function) of reducing the amount of leakage in a condition of holding the load pressure on the bottom side of the hydraulic cylinder 102.

The overload relief valve 326 functions to open the proportional seat valve 325 for draining the hydraulic fluid and preventing hose rupture in case that an excessive external force acts on the hydraulic cylinder 102 and the hydraulic pressure supplied to the bottom side of the hydraulic cylinder 102 is brought into a high-pressure level.

Also, if a hydraulic hose 105 leading from the control valve 103 to the input port 320 should be ruptured, the check valve 324 and the proportional seat valve 325 are closed to prevent a drop of a load supported by the hydraulic cylinder 102. In such an event, by operating a spool 341 of the pilot valve 340 with the pilot pressure and adjusting an opening area of the proportional seat valve 325, it is possible to slowly contract the hydraulic cylinder 102 under action of the weight of the load itself and to move the load to a safety position.

DISCLOSURE OF THE INVENTION

However, the above-described prior arts have a problem that it is difficult to reduce a pressure loss and to cut down an overall size and production cost of the valve unit.

More specifically, in the prior art shown in FIGS. 14 and 15, various components, i.e., the check valve 212 for fluid supply, the main spool 211, the poppet valve body 214 controlled by the pilot portion 213 provided on the main spool 211, and the overload relief valve 215, are separately provided corresponding to the respective functions.

Therefore, incorporating all those components in the housing 204 of a certain restricted size imposes a limitation on sizes of the individual components. Also, there has been a difficulty in reducing the production cost.

On the other hand, since all of the hydraulic fluid discharged from the hydraulic cylinder 102 passes through the main spool 211, a spool valve body of the main spool 211 is required to have a larger diameter. Further, because of the main spool 211 and the poppet valve body 214 being provided in series, the hydraulic fluid passes through these two valve elements at a large flow rate. Accordingly, when those parts are incorporated in the housing 204 of the certain restricted size, their sizes are necessarily limited, which may result in that a sufficient flow passage is not ensured and a pressure loss is increased. In addition, a pressure loss is also inevitably produced with such a construction that the hydraulic fluid passes at a large flow rate through both of the main spool 211 and the poppet valve body 214 provided in series.

The hose rupture control valve unit is mounted on the bottom side of a boom cylinder or the rod side of an arm cylinder. A boom and an arm, to which the boom cylinder and the arm cylinder are attached, are each a working member operated to rotate in the vertical direction. If the size of the housing 204 is selected to a relatively large value in consideration of the problem of a pressure loss, this selection would increase a risk that the hose rupture control valve unit may be damaged upon hitting against rocks or any other obstacles during the operation of the boom or the arm. It has been thus difficult to design the hose rupture control valve unit appropriately.

In the prior art disclosed in JP, A 3-249411, shown in FIG. 16, the overload relief valve 326 is incorporated in the proportional seat valve 325, which is controlled by the pilot valve 340, so that the proportional seat valve 325 has not only the function of the main spool 211, but also the functions of the poppet valve body 214 and the overload relief valve 215 in the above-described former prior art. Therefore, the number of components is reduced as compared with that needed in the above-described former prior art, and a reduction in size of the valve unit can be achieved to some extent while lessening a pressure loss. With this disclosed prior art, however, the check valve 324 for fluid supply is still an essential component. In other words, there is a demand for a further improvement in reducing the size and the production cost of the valve unit.

To overcome the problems mentioned above, the applicant proposed the following invention in JP, A 10-110776 (filing data: Apr. 21, 1998; corresponding to U.S. Appl. No. 09/294,431, EP Appl. No. 99201251.8, Korean Appl. No. 1999-13956, and Chinese Appl. No. 99105093.2).

"A hose rupture control valve unit provided between a supply/drain port of a hydraulic cylinder and a hydraulic hose for controlling a flow rate of a hydraulic fluid coming out from the supply/drain port to the hydraulic hose in accordance with an external signal, wherein the valve unit comprises a poppet valve body serving as a main valve slidably disposed in a housing provided with a cylinder connecting chamber connected to the supply/drain port, a hose connecting chamber connected to the hydraulic hose, and a back pressure chamber, the poppet valve body being able to selectively cut off and establish communication between the cylinder connecting chamber and the hose connecting chamber, and changing an opening area depending on the shift amount thereof, and a spool valve body serving as a pilot valve disposed in a pilot passage connecting the back pressure chamber and the hose connecting chamber, and operated in accordance with the external signal to cut off and control a rate of pilot flow passing through the pilot passage depending on the shift amount thereof, the poppet valve body being provided with a feedback variable throttle passage which has an initial opening area when the poppet valve body is in a cutoff position, and increases an opening area thereof depending on the shift amount of the poppet valve body, thereby controlling the rate of pilot flow coming out from the cylinder connecting chamber to the back pressure".

With the thus-constructed valve unit of the earlier filed invention, in operation of supplying the hydraulic fluid to the bottom side of the hydraulic cylinder, since the feedback variable throttle passage has the initial opening area, the poppet valve body is opened when a pressure in the hose connecting chamber rises to a level higher than a load pressure, allowing the hydraulic fluid to be supplied to the bottom side of the hydraulic cylinder (conventional check valve function on the supply side).

In operation of discharging the hydraulic fluid from the bottom side of the hydraulic cylinder, when the spool valve body is operated in accordance with the external signal and the pilot flow is produced at a rate depending on the shift amount of the spool valve body, the poppet valve body is opened and the shift amount thereof is controlled depending on the pilot flow rate. Therefore, most of the hydraulic fluid on the bottom side of the hydraulic cylinder passes through the poppet valve body, whereas the remaining hydraulic fluid passes through the feedback variable throttle passage, the back pressure chamber and the spool valve body. Both the flows of the hydraulic fluid are then drained to the reservoir (conventional main spool function).

Further, in operation of holding the load pressure on the bottom side of the hydraulic cylinder, the poppet valve body is in the cutoff position and holds the load pressure, thereby reducing the amount of leakage (load check function).

Thus, the valve unit of the earlier filed invention can fulfill the least necessary functions of a hose rupture control valve unit (i.e., the check valve function on the supply side, the main spool function, and the load check function). Also, in the valve unit of the earlier filed invention, the poppet valve body is only one component arranged in a flow passage through which the hydraulic fluid passes at a large flow rate. It is hence possible to reduce a pressure loss, and to cut down an overall size and production cost of the valve unit.

An object of the present invention is to improve the earlier filed invention and to provide a hose rupture control valve unit which can reduce a pressure loss and cut down an overall size and production cost of the valve unit while ensuring various functions that are the least necessary as a hose rupture control valve unit, and which can offer smooth flow control characteristics and set a more variety of flow control characteristics.

(1) To achieve the above object, the present invention provides a hose rupture control valve unit provided between a supply/drain port of a hydraulic cylinder and a hydraulic hose for controlling a flow rate of a hydraulic fluid coming out from the supply/drain port to the hydraulic hose in accordance with an external signal, wherein the valve unit comprises a poppet valve body serving as a main valve slidably disposed in a housing provided with a cylinder connecting chamber connected to the supply/drain port, a hose connecting chamber connected to the hydraulic hose, and a back pressure chamber, the poppet valve body being able to selectively cut off and establish communication between the cylinder connecting chamber and the hose connecting chamber, and changing an opening area depending on the shift amount thereof; a feedback variable throttle passage provided in the poppet valve body, having an initial opening area when the poppet valve body is in a cutoff position, and increasing an opening area thereof depending on the shift amount of the poppet valve body; a first variable throttle portion disposed in a pilot passage connecting the back pressure chamber and the hose connecting chamber, and operated in accordance with the external signal to cut off and control a rate of pilot flow flowing from the cylinder connecting chamber to the hose connecting chamber through the feedback variable throttle passage, the back pressure chamber and the pilot passage; and a second variable throttle portion disposed in a sub-passage connecting the cylinder connecting chamber and the hose connecting chamber, and operated in accordance with the external signal to cut off and control a rate of sub-flow passing through the sub-passage.

The construction that the poppet valve body and the first variable throttle portion are provided and the poppet valve body includes the feedback variable throttle passage having an initial opening area, is the same as that of the earlier filed invention. With this construction, a pressure loss can be reduced and an overall size and production cost of the valve unit can be cut down, while ensuring various functions that are the least necessary as a hose rupture control valve unit.

Further, the second variable throttle portion is provided in the sub-passage so that it is given with the function of flow rate control in the fine operating range. Therefore, flow rate control in the fine operation range performed by the second variable throttle portion and control of the poppet valve body performed by the first variable throttle portion can made separately from each other. As a result, smooth flow control characteristics are obtained and a more variety of flow control characteristics can be set.

(2) In the above (1), preferably, opening timings of the first and second variable throttle portions are set such that the second variable throttle portion is opened earlier than the first variable throttle portion in accordance with the external signal.

With this feature, as mentioned in the above (1), the second variable throttle portion is given with the function of flow rate control in the fine operating range, and flow rate control in the fine operation range performed by the second variable throttle portion and control of the poppet valve body performed by the first variable throttle portion can made separately from each other.

(3) In the above (1), preferably, the first variable throttle portion and the second variable throttle portion are provided on separate spool valve bodies.

With this feature, the opening timings of the first variable throttle portion and the second variable throttle portion can be changed by not only the notch position of each of variable throttle portion, but also the strength of a spring acting upon each spool valve body. Therefore, flow control characteristics can be set with good accuracy.

(4) In the above (1), preferably, the first variable throttle portion and the second variable throttle portion are provided on the same spool valve body.

With this feature, the number of parts of the valve unit is reduced and the size of the valve unit can be further reduced.

(5) In any of the above (1) to (4), preferably, the hose rupture control valve unit further comprises means for cutting off the sub-passage after opening the poppet valve.

In the construction wherein the sub-passage and the second variable throttle portion are provided in addition to the pilot passage and the first variable throttle portion as set forth in the above (1), the pilot flow rate and the sub-flow rate join with each other on the side of the hose connecting chamber. Therefore, the flow rate increases in a joining area and the downstream side thereof, which increases a passage pressure loss and causes a jet stream in the joining area to such an extent that the pressure in the back pressure chamber is increased or fluctuated. This results in a possibility that the poppet valve body may not be opened to have an opening area as per instructed by an external signal and control of a main flow rate may be adversely affected.

By cutting off the sub-passage after opening of the poppet valve body, only the pilot flow passes through the joining area after the sub-passage has been cut off. It is therefore possible to suppress an increase of the passage pressure loss and the occurrence of a jet stream due to joining of the pilot flow rate and the sub-flow rate, and to reduce an influence upon the control of the main flow rate.

(6) In the above (5), preferably, the means for cutting off the sub-passage is a land portion provided on a spool valve body including the second variable throttle portion, the land portion cutting off a flow passage of the second variable throttle portion when the spool valve body is shifted a predetermined distance or more.

With this feature, since the land portion is just additionally formed on the spool valve body, the sub-passage can be cut off with a simple construction.

BEST MODE FOR CARRYING OUT THE INVENTION

Preferred embodiments of the present invention will be described below with reference to the drawings.

Figure 1:
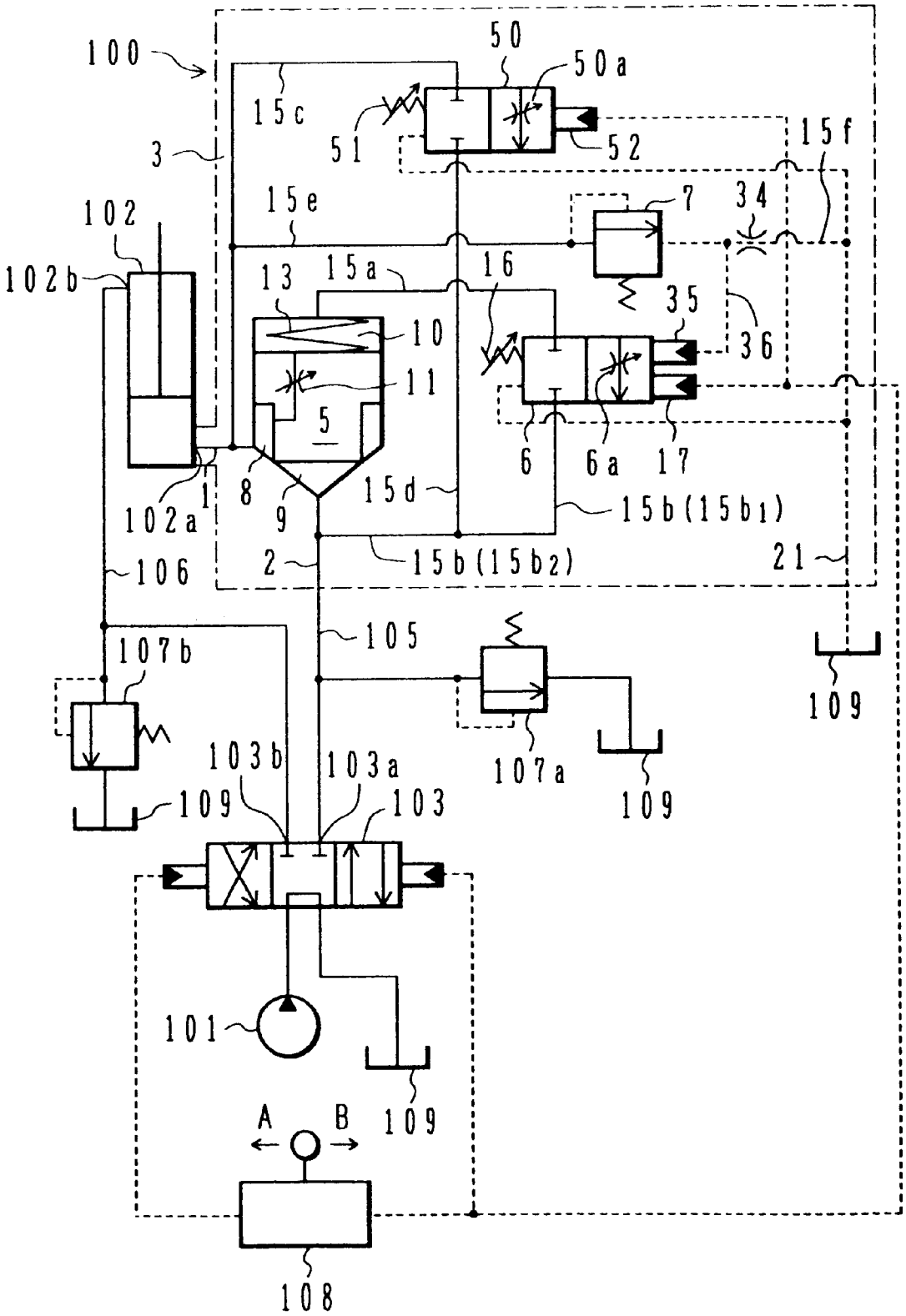
FIG. 1 is a hydraulic circuit diagram showing a hose rupture control valve unit according to a first embodiment of the present invention, along with a hydraulic drive system in which the valve unit is disposed.
Figure 2:
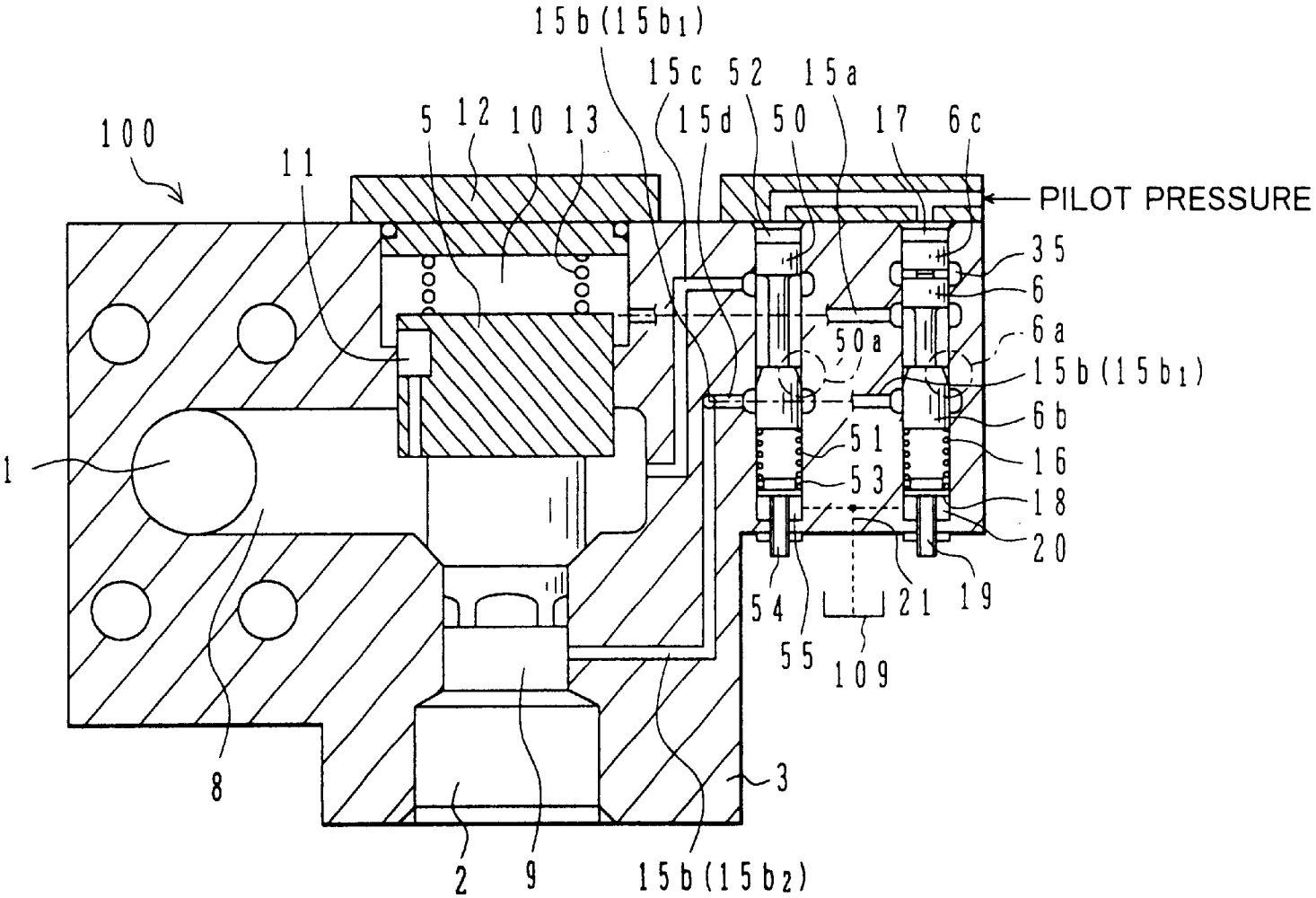
FIG. 2 is a sectional view showing the structure of a portion, i.e., a poppet valve body and a first spool valve body, of the hose rupture control valve unit shown in FIG. 1
Figure 3:
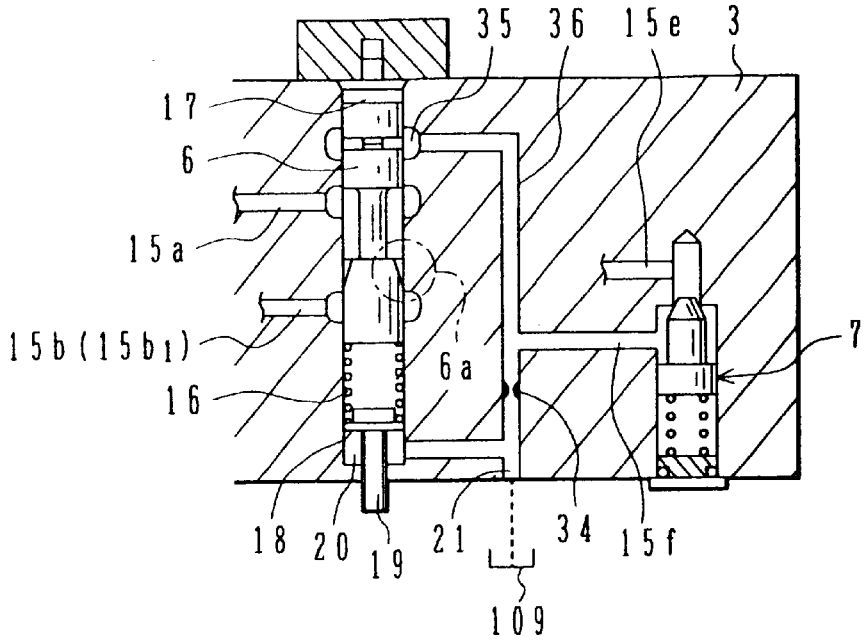
FIG. 3 is a sectional view showing the structure of another portion, i.e., a small relief valve, of the hose rupture control valve unit shown in FIG. 1.

FIG. 1 is a hydraulic circuit diagram showing a hose rupture control valve unit according to a first embodiment of the present invention, and FIGS. 2 and 3 are sectional views each showing the structure of the hose rupture control valve unit.

Referring to FIG. 1, numeral 100 denotes a hose rupture control valve unit of this embodiment. A hydraulic drive system, in which the valve unit 100 is disposed, comprises a hydraulic pump 101; a hydraulic actuator (hydraulic cylinder) 102 driven by a hydraulic fluid delivered from the hydraulic pump 101; a control valve 103 for controlling a flow of the hydraulic fluid supplied from the hydraulic pump 101 to the hydraulic cylinder 102; main overload relief valves 107*a*, 107*b* connected to actuator lines 105, 106, which are hydraulic hoses extended from the control valve 103, for limiting a maximum pressure in the hydraulic circuit; a manual pilot valve 108, and a reservoir 109.

As shown in FIGS. 1 and 2, the hose rupture control valve unit 100 comprises a housing 3 provided with two input/output ports 1 and 2. The input/output port 1 is directly attached to a bottom-side supply/drain port 102*a* of the hydraulic cylinder 102, and the input/output port 2 is connected to one 103*a* of actuator ports 103*a*, 103*b* of the control valve 103 via the actuator line 105. The actuator port 103*b* is connected to a rod-side supply/drain port 102*b* of the hydraulic cylinder 102 via the actuator line 106.

Within the housing 3, there are provided a poppet valve body 5 serving as a main valve; a first spool valve body 6 serving as a pilot valve which is operated with a pilot pressure supplied as an external signal from the manual pilot valve 108, thereby operating the poppet valve body 5; a second spool valve body 50 operated with the same pilot pressure as that supplied to the first spool valve body 6 and controlling a small range of flow rate; and a small relief valve 7 having the function of an overload relief valve.

Also, within the housing 3, there are defined a cylinder connecting chamber 8 connected to the input/output port 1, a hose connecting chamber 9 connected to the input/output port 2, and a back pressure chamber 10. The poppet valve body 5 serving as a main valve is slidably disposed in the housing 3 such that it is subjected at it back surface to a pressure in the back pressure chamber 10, and it selectively cuts off and establishes communication between the cylinder connecting chamber 8 and the hose connecting chamber 9 while its opening area is changed depending on the shift amount of thereof. The poppet valve body 5 is provided with a feedback slit 11 serving as a feedback variable throttle passage which increases its opening area depending on the shift amount of the poppet valve body 5 and controls a rate of pilot flow coming out from the cylinder connecting chamber 8 to the back pressure chamber 10 depending on the opening area thereof. The back pressure chamber 10 is closed by a plug 12 (see FIG. 2), and a spring 13 is disposed in the back pressure chamber 10 for holding the poppet valve body 5 in the cutoff position as shown.

Further, in the housing 3, pilot passages 15*a*, 15*b* are formed to communicate the back pressure chamber 10 and the hose connecting chamber 9 with each other, and the first spool valve body 6 serving as a pilot valve is disposed between the pilot passages 15*a* and 15*b*. The pilot 15*b* comprises two parts, i.e., passage portions 15*b*1, 15*b*2. The passage portion 15*b*2 serves also as part of a sub-passage (described later).

The first spool valve body 6 has a pilot variable throttle portion 6*a* comprising a plurality of notches and being able to communicate the pilot passages 15*a*, 15*b* with each other. A spring 16 for setting an initial valve-opening force of the pilot variable throttle portion 6*a* is disposed at an operating end of the first spool valve body 6 in the valve-closing direction, and a pressure bearing chamber 17, to which the pilot pressure is introduced as an external signal, is formed at an operating end of the first spool valve body 6 in the valve-opening direction. The shift amount of the first spool valve body 6 is determined by a control force given by the pilot pressure (external signal) introduced to the pressure bearing chamber 17 and an urging force produced by the spring 16. Depending on the shift amount of the first spool valve body 6, the opening area of the pilot variable throttle portion 6*a* is changed to selectively cut off and control the pilot flow rate passing through the pilot passages 15*a*, 15*b*. The spring 16 is supported by a spring receiver 18 including a threaded portion 19 which enables an initial setting force of the spring 16 (i.e., the initial valve-opening force of the pilot variable throttle portion 6*a*) to be adjusted. A spring chamber 20, in which the spring 16 is disposed, is connected to the reservoir via a drain passage 21 so that the first spool valve body 6 moves smoothly.

Moreover, in the housing 3, sub-passages 15*c*, 15*d* are formed to communicate the cylinder connecting chamber 8 and the hose connecting chamber 9 with each other. The second spool valve body 50 is disposed between the sub-passages 15*c* and 15*d*. The sub-passage 15*d* is connected to the hose connecting chamber 9 via the portion 15*b*2 of the pilot passage 15*b*. Thus, the passage portion 15*b*2 serves as not only the pilot passage, but also the sub-passage.

The second spool valve body 50 has a sub-variable throttle portion 50*a* comprising a plurality of notches and being able to communicate the sub-passages 15*c*, 15*d* with each other. A spring 51 for setting an initial valve-opening force of the sub-variable throttle portion 50*a* is disposed at an operating end of the second spool valve body 50 in the valve-closing direction, and a pressure bearing chamber 52, to which the pilot pressure is introduced as an external signal, is formed at an operating end of the second spool valve body 50 in the valve-opening direction. The shift amount of the second spool valve body 50 is determined by a control force given by the pilot pressure (external signal) introduced to the pressure bearing chamber 52 and an urging force produced by the spring 51. Depending on the shift amount of the second spool valve body 50, the opening area of the sub-variable throttle portion 50*a* is changed to selectively cut off and control a sub-flow rate passing through the sub-passages 15*c*, 15*d*. The spring 51 is supported by a spring receiver 53 including a threaded portion 54 which enables an initial setting force of the spring 51 (i.e., the initial valve-opening force of the sub-variable throttle portion 50*a*) to be adjusted. A spring chamber 55, in which the spring 51 is disposed, is connected to the reservoir via the drain passage 21 so that the second spool valve body 50 moves smoothly.

Additionally, in the housing 3, there are formed a relief passage 15*e* positioned on the inlet side of the small relief valve 7, and a drain passage 15*f* positioned on the outlet side of the small relief valve 7. The relief passage 15*e* is connected to the cylinder connecting chamber 8, and the drain passage 15*f* is connected to the reservoir via the drain passage 21. Further, a throttle 34 as means for producing a pressure is provided in the drain passage 15*f*, and a signal passage 36 is branched from a point between the small relief valve 7 and the throttle 34.

At the operating end of the first spool valve body 6 in the valve-opening direction, another pressure bearing chamber 35 is defined in addition to the pressure bearing chamber 17 to which the pilot pressure (external signal) introduced. The signal passage 36 is connected to the pressure bearing chamber 35 so that the pressure produced by the throttle 34 acts upon the first spool valve body 6 as a driving force on the same side as the pilot pressure introduced thereto as an external signal.

FIG. 3 shows the detailed construction of the pressure bearing chambers 17, 35. The first spool valve body 6 is divided into a main spool portion 6*b* including the pilot variable throttle portion 6*a* formed thereon, and a piston portion 6*c* positioned on the side remote from the spring 16 in an adjacent relation to the main spool portion 6*b*. The pressure bearing chamber 17 is provided at an end of the piston portion 6*c* on the side remote from the main spool portion 6*b*, and the pressure bearing chamber 35 is provided at a portion where the main spool portion 6*b* and the piston portion 6*c* are adjacent to each other. This construction enables both of the pilot pressure introduced to the pressure bearing chamber 17 and the pressure produced by the throttle 34 and introduced to the pressure bearing chamber 35 to act upon the variable throttle portion 6*a* in the opening direction.

Figure 4:
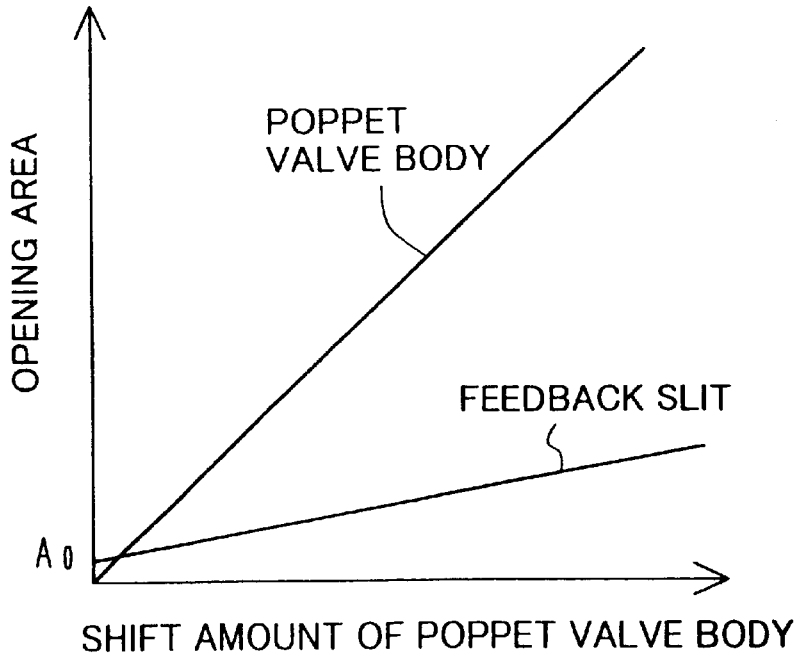
FIG. 4 is a graph showing the relationships of an opening area of the poppet valve body and an opening area of a feedback slit with respect to the shift amount (stroke) of the poppet valve body.

FIG. 4 is a graph showing the relationships of an opening area of the poppet valve body 5 and an opening area of the feedback slit 11 with respect to the shift amount (stroke) of the poppet valve body 5. When the poppet valve body 5 is in the cutoff position, the feedback slit 11 has a predetermined initial opening area $A_0$. As the poppet valve body 5 starts moving from the cutoff position and the shift amount thereof increases, the opening areas of the poppet valve body 5 and the feedback slit 11 are increased proportionally. Because of the feedback slit 11 having the initial opening area $A_0$, the poppet valve body 5 can perform the function of the conventional check valve for fluid supply (described later).

Figure 5:
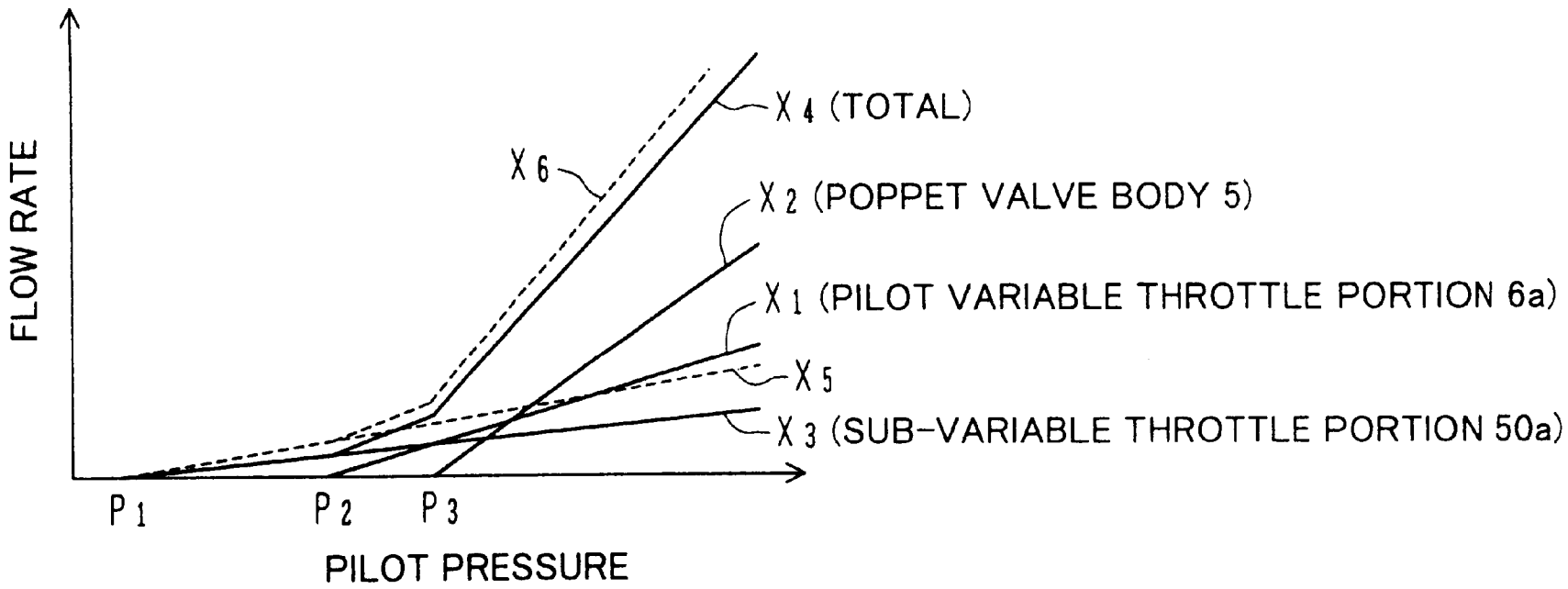
FIG. 5 is a graph showing the relationships of a characteristic of flow rate passing through a pilot variable throttle portion (pilot flow rate), a characteristic of flow rate passing through the poppet valve body (main flow rate), a characteristic of flow rate passing through a sub-variable throttle portion (sub-flow rate), and a characteristic of total flow rate with respect to a pilot pressure in the hose rupture control valve unit shown in FIG. 1.

FIG. 5 is a graph showing the relationships of a flow rate passing through the pilot variable throttle portion 6*a* of the first spool valve body 6 (pilot flow rate) and a flow rate passing through the poppet valve body (main flow rate) with respect to the pilot pressure supplied as an external signal from the manual pilot valve 108, the relationship between those flow rates and a flow rate passing through the sub-variable throttle portion 50*a* of the second spool valve body 50 (sub-flow rate), as well as the relationship between those flow rates and a total flow rate passing through the valve unit 100. X1 represents a characteristic line of flow rate control performed by the pilot variable throttle portion 6*a*, X2 represents a characteristic line of flow rate control performed by the poppet valve body 5, and X3 represents a characteristic line of flow rate control performed by the sub-variable throttle portion 50*a*. X4 represents a characteristic line of total flow rate control, i.e., a characteristic line of flow rate control performed by the valve unit 100.

In FIG. 5, the range of the pilot pressure from 0 to $P_2$ corresponds to a dead zone of the pilot variable throttle portion 6*a* of the first spool valve body 6. Even with the pilot pressure rising in that range, the first spool valve body 6 is held stopped by the initial setting force of the spring 16 or, even if shifted, it is located in an overlap region resulting before the pilot variable throttle portion 6*a* is opened. The pilot variable throttle portion 6*a* therefore remains in the cutoff position. As indicated by the characteristic line X1, when the pilot pressure reaches $P_2$, the pilot variable throttle portion 6*a* of the first spool valve body 6 starts opening and the opening area of the pilot variable throttle portion 6*a* increases as the pilot pressure rises over $P_2$. Correspondingly, the rate of fluid flow passing through the pilot variable throttle portion 6*a*, i.e., the pilot flow rate passing through the pilot passages 15*a* and 15*b*, also increases.

Also, the range until the pilot flow rate reaches a predetermined value at the pilot pressure $P_3(>P_2)$ corresponds to a dead zone of the poppet valve body 5. During this dead zone, a pressure fall occurred in the back pressure chamber 10 due to the presence of the feedback slit 11 is insufficient even with the pilot flow rate produced to some extent, and therefore the poppet valve body 5 is held in the cutoff position by the initial setting force of the spring 13. As indicated by the characteristic line X2, when the pilot flow rate reaches a predetermined value at the pilot pressure $P_3$, the poppet valve body 5 starts opening and the opening area of the poppet valve body 5 increases as the pilot pressure rises over $P_3$. Correspondingly, the rate of fluid flow passing through the poppet valve body 5, i.e., the main flow rate, also increases.

Further, the range of the pilot pressure from 0 to $P_1$ corresponds to a dead zone of the sub-variable throttle portion 50*a* of the second spool valve body 50. Even with the pilot pressure rising in that range, the second spool valve body 50 is held stopped by the initial setting force of the spring 51 or, even if shifted, it is located in an overlap region resulting before the sub-variable throttle portion 50*a* is opened. The sub-variable throttle portion 50*a* therefore remains in the cutoff position. As indicated by the characteristic line X3, when the pilot pressure reaches $P_1$, the sub-variable throttle portion 50*a* of the second spool valve body 50 starts opening and the opening area of the sub-variable throttle portion 50*a* increases as the pilot pressure rises over $P_1$. Correspondingly, the rate of fluid flow passing through the sub-variable throttle portion 50*a*, i.e., the sub-flow rate passing through the sub-passages 15*c* and 15*d*, also increases.

In addition, by satisfying $P_1>P_2$ and setting the opening timing such that the sub-variable throttle portion 50*a* of the second spool valve body 50 is opened with the pilot pressure at earlier timing than the pilot variable throttle portion 6*a*of the first spool valve body 6, the sub-variable throttle portion 50*a* is given with the function of flow rate control in the fine operation range.

As a result of that the respective flow rates passing through the pilot variable throttle portion 6*a* of the first spool valve body 6, the poppet valve body 5, and the sub-variable throttle portion 50*a* of the second spool valve body 50 are changed as described above, the total flow rate passing through the valve unit 100 is changed as indicated by the characteristic line X4.

In FIG. 5, a gradient of the characteristic line X1 relating to the pilot variable throttle portion 6*a* of the first spool valve body 6 can be adjusted by changing the notch size of the pilot variable throttle portion 6*a*, and a start end of the characteristic line X1, i.e., the opening timing of the pilot variable throttle portion 6*a*, can be adjusted by adjusting the strength (initial setting force) of the spring 16 or the notch position of the pilot variable throttle portion 6*a*. Also, by so changing the gradient or opening timing of the characteristic line X1 of the pilot variable throttle portion 6*a* of the first spool valve body 6, the pilot pressure at which the pilot pressure reaches the predetermined value is changed, thus enabling the opening timing of the poppet valve body 5 (start end of the characteristic line X2) to be adjusted. Further, a gradient of the characteristic line X3 relating to the sub-variable throttle portion 50*a* of the second spool valve body 50 can be adjusted by changing the notch size of the sub-variable throttle portion 50*a*, and a start end of the characteristic line X3, i.e., the opening timing of the sub-variable throttle portion 50*a*, can be adjusted by adjusting the strength (initial setting force) of the spring 51 or the notch position of the sub-variable throttle portion 50*a*.

Next, the operation of the hose rupture control valve unit 100 thus constructed will be described.

A description is first made of the operation in a normal condition where the actuator line 105 is not ruptured.

1) Supply of Hydraulic Fluid to Bottom Side of Hydraulic Cylinder 102

When a control lever of the manual pilot valve 108 is operated in the direction A denoted in FIG. 1 to shift the control valve 103 to take a right-hand position as viewed in the drawing, the hydraulic fluid from the hydraulic pump 101 is supplied to the hose connecting chamber 9 of the valve unit 100 through the control valve 103, causing the pressure in the hose connecting chamber 9 to rise. At this time, since the pressure in the cylinder connecting chamber 8 of the valve unit 100 is equal to the load pressure on the bottom side of the hydraulic cylinder 102 and the feedback slit 11 has the initial opening area $A_0$, the pressure in the back pressure chamber 10 is also equal to that load pressure. Accordingly, while the pressure in the hose connecting chamber 9 is lower than the load pressure, the poppet valve body 5 is held in the cutoff position. As soon as the pressure in the hose connecting chamber 9 becomes higher than the load pressure, the poppet valve body 5 starts to move upward in the drawing, allowing the hydraulic fluid to flow into the cylinder connecting chamber 8. Thus, the hydraulic fluid from the hydraulic pump 101 is supplied to the bottom side of the hydraulic cylinder 102. While the poppet valve body 5 is moving upward, the hydraulic fluid in the back pressure chamber 10 displaces into the cylinder connecting chamber 8 through the feedback slit 11 for ensuring smooth opening of the poppet valve body 5. The hydraulic fluid from the rod side of the hydraulic cylinder 102 is drained to the reservoir 109 through the control valve 103.

2) Discharge of Hydraulic Fluid from Bottom Side of Hydraulic Cylinder 102 to Control Valve 103

When the control lever of the manual pilot valve 108 is operated in the direction B denoted in FIG. 1 to shift the control valve 103 to take a left-hand position as viewed in the drawing, the hydraulic fluid from the hydraulic pump 101 is supplied to the rod side of the hydraulic cylinder 102 through the control valve 103. At the same time, the pilot pressure from the manual pilot valve 108 is introduced to the pressure bearing chamber 17 of the first spool valve body 6 to shift the first spool valve body 6 with the pilot pressure, whereupon the pilot variable throttle portion 6*a*of the first spool valve body 6 has an opening area corresponding the shift amount thereof. Accordingly, as described above, the hydraulic fluid passes through the pilot passages 15*a*, 15*b* at the pilot flow rate depending on the pilot pressure, and the poppet valve body 5 is opened and controlled in the shift amount thereof depending on the pilot flow rate. The pilot pressure from the manual pilot valve 108 is also introduced to the pressure bearing chamber 2 of the second spool valve body 50 to shift the second spool valve body 50 with the pilot pressure, whereupon the pilot variable throttle portion 50*a* of the second spool valve body 50 has an opening area corresponding the shift amount thereof. Accordingly, as described above, the hydraulic fluid passes through the sub-passages 15*c*, 15*d* at the sub-flow rate depending on the pilot pressure. As a result, the hydraulic fluid on the bottom side of the hydraulic cylinder 102 is drained to the control valve 103 and then to the reservoir 109 while being controlled by the poppet valve body 5, the first spool valve body 6, and the second spool valve body 50 of the valve unit 100.

3) Holding of Load Pressure on Bottom Side of Hydraulic Cylinder 102

In a condition where the load pressure on the bottom side of the hydraulic cylinder 102 becomes high, as occurred in the case of holding a lifted load with the control valve 103 maintained at the neutral position, the poppet valve body 5 in the cutoff position performs the function of holding the load pressure and reducing the amount of leakage (load check function) as with the conventional load check valve.

4) In Case of Excessive External Force Acting upon Hydraulic Cylinder 102

In case that an excessive external force acts upon the hydraulic cylinder 102 and the pressure in the cylinder connecting chamber 8 becomes high, the pressure in the relief passage 15*e* rises and the small relief valve 7 is opened, allowing the hydraulic fluid to flow into the drain passage 15*f* in which the throttle 34 is disposed. As a result, the pressure in the signal passage 36 rises and the first spool valve body 6 is shifted to open the pilot variable throttle portion 6*a* for producing a pilot flow passing through the pilot passages 15*a*, 15*b*. Hence, the poppet valve body 5 is also opened and the hydraulic fluid brought into a high-pressure level under action of the external force is drained to the reservoir 109 through the overload relief valve 107*a* connected to the actuator line 105, thereby preventing damage of the equipment. On that occasion, since the hydraulic fluid passes the small relief valve 7 at a small flow rate, the function equivalent to that of the conventional overload relief valve can be realized with the small relief valve 7 having a small size.

If the actuator line 105 should be ruptured, the poppet valve body 5 in the cutoff position functions as a load check valve (holding valve) similarly to the above-described case of holding a lifted load, thereby blocking outflow of the hydraulic fluid on the bottom side of the hydraulic cylinder 102 to prevent a drop of a boom. When lowering the boom down to a safety position from that condition, an operator operates the control lever of the manual pilot valve 108 in the direction B denoted in FIG. 1. With this lever operation, as described above, the pilot pressure from the manual pilot valve 108 is introduced to the pressure bearing chamber 17 of the spool valve body 6 to open the spool valve body 6 with the pilot pressure, whereupon the poppet valve body 5 is also opened. Accordingly, the hydraulic fluid on the bottom side of the hydraulic cylinder 102 can be discharged under flow rate control and the boom can be slowly lowered.

With this embodiment, as described above, just by providing the poppet valve body 5 in a flow passage through which all of the hydraulic fluid supplied to and discharged from the hydraulic cylinder 102 passes, the poppet valve body 5 can fulfill the functions of the check valve for fluid supply, the load check valve, and the overload relief valve in the conventional hose rupture control valve unit. Therefore, a valve unit having a small pressure loss can be constructed, and highly efficient operation can be achieved with a less energy loss. Also, since the valve unit 100 has a smaller size than the conventional hose rupture control valve unit, a possibility that the valve unit may be damaged during works is reduced, and flexibility in design is increased. Furthermore, the reduced number of components contributes to reducing the failure frequency, improving the reliability, and enabling the valve unit to be produced at a relatively low cost.

Moreover, the poppet valve body 5 is opened by causing the hydraulic fluid, that is brought into a high-pressure level under action of an excessive external force, to act upon the small relief valve 7, and the hydraulic fluid passes through the small relief valve 7 at a small flow rate when the high-pressure hydraulic fluid is released to the reservoir through the main overload relief valve 107*a*. The function equivalent to that of the conventional overload relief valve can be therefore realized with the small relief valve 7 having a small size. In addition, since the hydraulic fluid is released from the small relief valve 7 to the reservoir via the drain passage 21 that is identical to a drain line formed in the conventional valve unit, a drain hose specific to the overload relief valve is no longer required in the valve unit 100, and routing of the hose around the valve unit 100 can be simplified.

The above-described advantages are the same as those obtained by JP, A 10-110776, i.e., the invention earlier filed by the applicant.

In the valve unit 100 of the present invention, the sub-passages 15*c*, 15*d* and the second spool valve body 50 are provided in addition to the construction of the valve unit of the earlier filed invention, so that smooth flow control characteristics can be obtained and a more variety of flow control characteristics can be set. These features will be described below in more detail with reference to the drawings.

Figure 6:
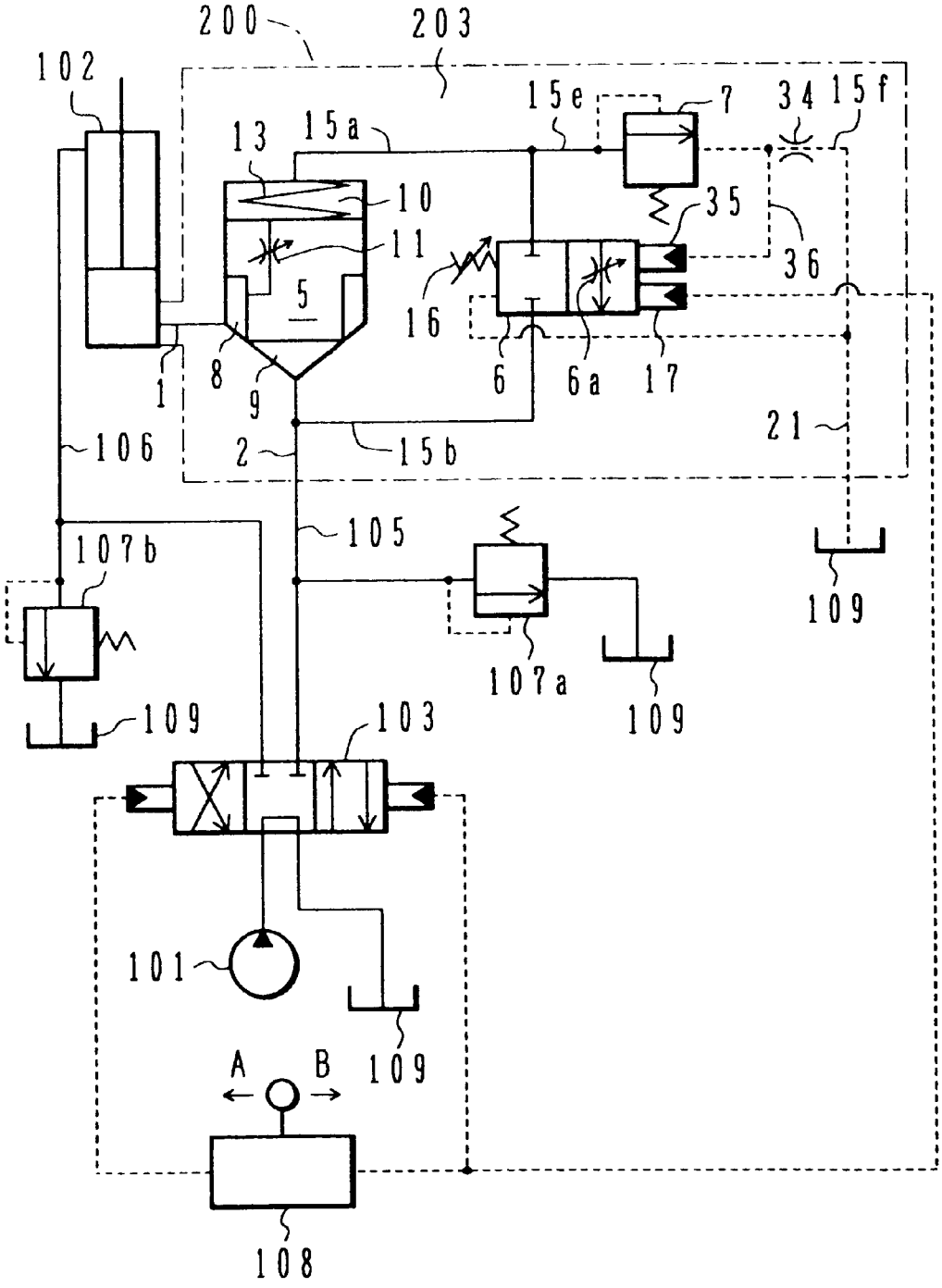
FIG. 6 is a hydraulic circuit diagram showing, as a comparative example, a hose rupture control valve unit of the earlier filed invention, along with a hydraulic drive system in which the valve unit is disposed.

FIG. 6 shows, as a comparative example, the valve unit of the earlier filed invention, and a description is first made of this valve unit. In FIG. 6, identical members to those in FIG. 1 are denoted by the same numerals.

Referring to FIG. 6, numeral 200 denotes the valve unit of the earlier filed invention. The valve unit 200 is the same as the one 100 of this embodiment shown in FIG. 1 except for that neither the sub-passages 15*c*, 15*d* nor the second spool valve body 50, shown in FIG. 1, are provided in a housing 203, and the relief passage 15*e* is connected to not the cylinder connecting chamber 8, but the back pressure chamber 10.

To describe such a difference in position to which the relief passage 15*e* is connected, a similar overload relief function can also be obtained by connecting the relief passage 15*e* to not the cylinder connecting chamber 8, but the back pressure chamber 10, because the high pressure in the hydraulic cylinder 102 is transmitted to the relief passage 15*e* through the feedback slit 11 and the back pressure chamber 10. In this case, however, since the feedback slit 11 (throttle) is interposed between the hydraulic cylinder 102 and the relief passage 15*e*, there is a possibility that the operation of the small relief valve 7 may be unstable in dynamic fashion. By contrast, in the valve unit 100 of this embodiment shown in FIG. 1, since the high pressure in the hydraulic cylinder 102 is directly introduced to the relief passage 15*e*, it is possible to operate the small relief valve 7 with a better response and to ensure a stable relief function.

Figure 7:
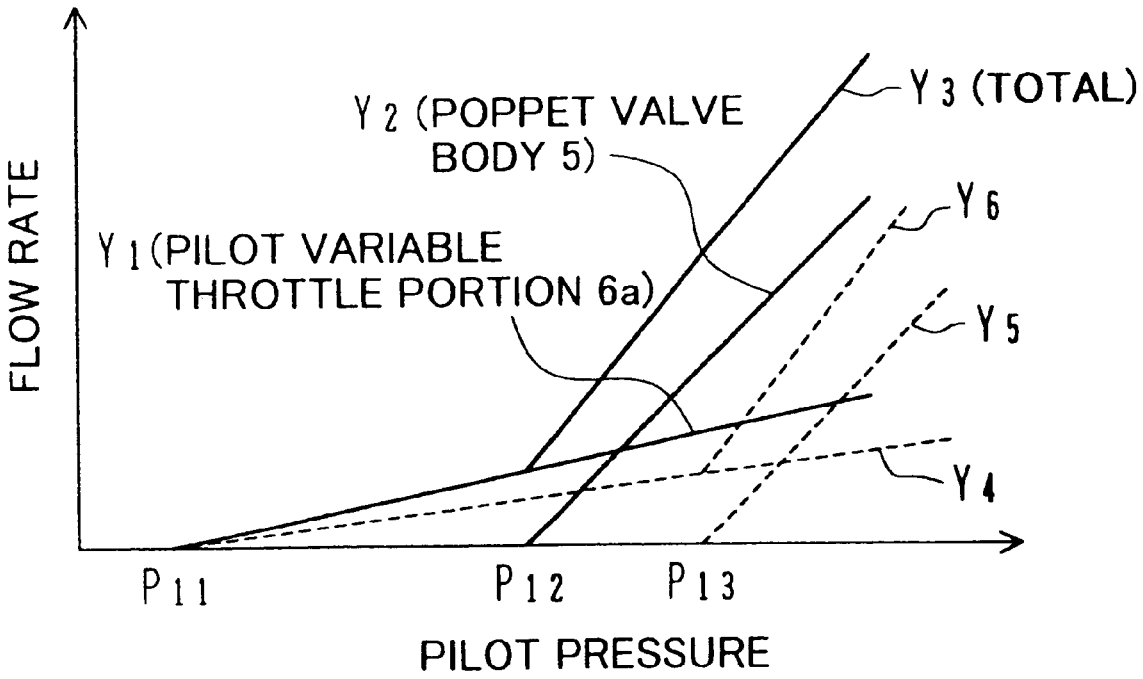
FIG. 7 is a graph showing the relationships of a flow rate passing through a pilot variable throttle portion of a spool valve body (pilot flow rate) and a flow rate passing through a poppet valve body (main flow rate) with respect to a pilot pressure in the hose rupture control valve unit shown in FIG. 6.

FIG. 7 is a graph showing the relationships of the flow rate passing through a pilot variable throttle portion 6*a* of the spool valve body 6 (pilot flow rate) and a flow rate passing through a poppet valve body 5 (main flow rate) with respect to the pilot pressure supplied as an external signal in the valve unit 200 shown in FIG. 6, as well as the relationship between those flow rates and a total flow rate passing through the valve unit 200. Y1 represents a characteristic line of flow rate control performed by the pilot variable throttle portion 6*a*, Y2 represents a characteristic line of flow rate control performed by the poppet valve body 5, and Y3 represents a characteristic line of total flow rate control, i.e., a characteristic line of flow rate control performed by the valve unit 200.

In FIG. 7, the range of the pilot pressure from 0 to $P_{11}$ corresponds to a dead zone of the pilot variable throttle portion 6*a* of the spool valve body 6. Even with the pilot pressure rising in that range, the spool valve body 6 is held stopped by the initial setting force of the spring 16 or, even if shifted, it is located in an overlap region resulting before t he pilot variable throttle portion 6*a* is opened. The pilot variable throttle portion 6*a* therefore remains in the cutoff position. As indicated by the characteristic line Y1, when the pilot pressure reaches $P_{11}$, the pilot variable throttle portion 6*a* of the spool valve body 6 starts opening and the opening area of the pilot variable throttle portion 6*a* increases as the pilot pressure rises over $P_{12}$. Correspondingly, the rate of fluid flow passing through the pilot variable throttle portion 6*a*, i.e., the pilot flow rate passing through pilot passages 15*a* and 15*b*, also increases.

Also, the range until the pilot flow rate reaches a predetermined value at the pilot pressure $P_{12}$ ($>P_{11}$) corresponds to a dead zone of the poppet valve body 5. During this dead zone, a pressure fall occurred in the back pressure chamber 10 due to the presence of the feedback slit 11 is insufficient even with the pilot flow rate produced to some extent, and therefore the poppet valve body 5 is held in the cutoff position by the initial setting force of the spring 13. As indicated by the characteristic line Y2, when the pilot flow rate reaches a predetermined value at the pilot pressure $P_{12}$, the poppet valve body 5 starts opening and the opening area of the poppet valve body 5 increases as the pilot pressure rises over $P_{12}$. Correspondingly, the rate of fluid flow passing through the poppet valve body 5, i.e., the main flow rate, also increases.

As a result of that the respective flow rates passing through the pilot variable throttle portion 6*a* of the spool valve body 6 and the poppet valve body 5 are changed as described above, the total flow rate passing through the valve unit 200 is changed as indicated by the characteristic line Y3.

In the valve unit 200 of the earlier filed invention, however, since flow rate control in the fine operation range (range where the amount by which a lever of the manual control valve 108 is operated is small and the pilot pressure is low) and control of the poppet valve body 5 are both performed by the same pilot variable throttle portion 6*a* of the spool valve body 6, the overall range of the flow rate control is changed upon change of flow control characteristics in the fine operation range and smooth flow control characteristics are not obtained sometimes.

For example, if the flow control characteristic of the pilot variable throttle portion 6*a* of the spool valve body 6 is modified in the valve unit 200 of the earlier filed invention by changing the characteristic line from Y1 to Y4 having a smaller gradient in order to improve operability in the fine operation range (fine operability), the opening timing of the poppet valve body 5 is shifted from the point $P_{12}$ to $P_{13}$ and the characteristic line of the flow rate control performed by the poppet valve body 5 is changed from Y2 to Y5, whereby the characteristic of the total flow rate passing through the valve unit 200 is changed as indicated by Y6. In this case, the fine operability is improved because of the characteristic line Y4 having a smaller gradient, but a maximum flow rate (flow rate resulting under a maximum pilot pressure when the lever is fully operated) passing through the valve unit 200 is reduced. Therefore, the overall range of the flow rate control is reduced and smooth flow control characteristics are not obtained. Also, when the opening timing of the spool valve body 6 is shifted from the point $P_{11}$, the opening timing of the poppet valve body 5 is likewise shifted from the point $P_{12}$, thus resulting in that the overall range of the flow rate control is reduced and smooth flow control characteristics are not obtained.

By contrast, in the valve unit 100 of this embodiment shown in FIG. 1, the second spool valve body 50 is further provided and the sub-variable throttle portion 50*a* of the second spool valve body 50 is disposed in the sub-passages 15*c*, 15*d* separate from the pilot passages 15*a*, 15*b* of the poppet valve body 5. Therefore, even when the flow control characteristic of the sub-variable throttle portion 50*a* is changed, the pilot flow rate passing through the pilot passages 15*a*, 15*b* is not changed and the opening timing of the poppet valve body 5 is also not changed. Also, by setting the opening timing such that the sub-variable throttle portion 50*a* is opened with rising of the pilot pressure at earlier timing than the pilot variable throttle portion 6*a*of the first spool valve body 6, the sub-variable throttle portion 50*a* is given with the function of flow rate control in the fine operation range. Stated otherwise, in this embodiment, the flow rate control in the fine operation range and the control performed by the poppet valve body 5 are separated from each other by adding the sub-variable throttle portion 50*a* of the second spool valve body 50.

By thus separating the flow rate control in the fine operation range and the control performed by the poppet valve body 5, the opening timing of the poppet valve body 5 can be set regardless of the flow rate control in the fine operation range, and the overall range of the flow rate control is not changed even when the flow control characteristic in the fine operation range is changed. Hence, even when modifying the characteristic line of the flow rate control to have a smaller gradient for improving the operability in the fine operation range, smooth flow control characteristics can be obtained.

Assuming, for example, that the characteristic line of the sub-variable throttle portion 50*a* of the second spool valve body 50 is given by a broken line X5 in FIG. 5, even when the characteristic line is modified to have a smaller gradient, i.e., to X3 used in this embodiment, the opening timing of the poppet valve body 5 is not changed from the point $P_3$, whereas the characteristic of the total flow rate passing through the valve unit 100 is changed from X6 to X4. In other words, the flow control characteristic in the fine operation range is changed, but change of the maximum flow rate passing through the valve unit 100 is slight and the overall range of the flow rate control is hardly changed. Likewise, when the opening timing of the sub-variable throttle portion 50*a* of the second spool valve body 50 is shifted from the point $P_1$, the opening timing of the poppet valve body 5 is not changed from the point $P_3$, thus resulting in that the overall range of the flow rate control is hardly changed.

Furthermore, when characteristics (gradient of the characteristic line X and the opening timing) of the pilot variable throttle portion 50*a* of the second spool valve body 50 are changed to modify the flow control characteristic of the poppet valve body 5 on the contrary to the above case, the flow control characteristic in the fine operation range provided by the sub-variable throttle portion 50*a* of the second spool valve body 50 is hardly changed.

As described hereinabove, since the flow control characteristic in the fine operation range and the flow control characteristic of the poppet valve body 5 can be set individually and the overall range of the flow rate control is hardly changed even with change of the flow control characteristic in the fine operation range, smooth flow control characteristics can be achieved even in the case of modifying the characteristic line of the flow rate control to have a smaller gradient for improving the operability in the fine operation range.

Also, a more variety of flow control characteristics can be set by optionally combining change in characteristics of the sub-variable throttle portion 50*a* of the second spool valve body 50 and change in characteristics of the pilot variable throttle portion 6*a* of the first spool valve body 6 (change in characteristics of the poppet valve body 5) with each other. Therefore, flexibility in design is increased and the valve unit can be applied to various actuators (hydraulic cylinders) having different demanded flow control characteristics.

Further, in this embodiment, since the pilot variable throttle portion 6*a* and the sub-variable throttle portion 50*a* are provided on the spool valve bodies 6, 50 separate from each other, the opening timings of the pilot variable throttle portion 6*a* and the sub-variable throttle portion 50*a* can be changed by not only the notch position, but also the strengths of the springs 16, 51 acting upon the first and second spool valve bodies 6, 50.

A second embodiment of the present invention will be described with reference to FIGS. 8 and 9. In these drawings, identical members to those in FIGS. 1 and 2 are denoted by the same numerals.

Figure 8:
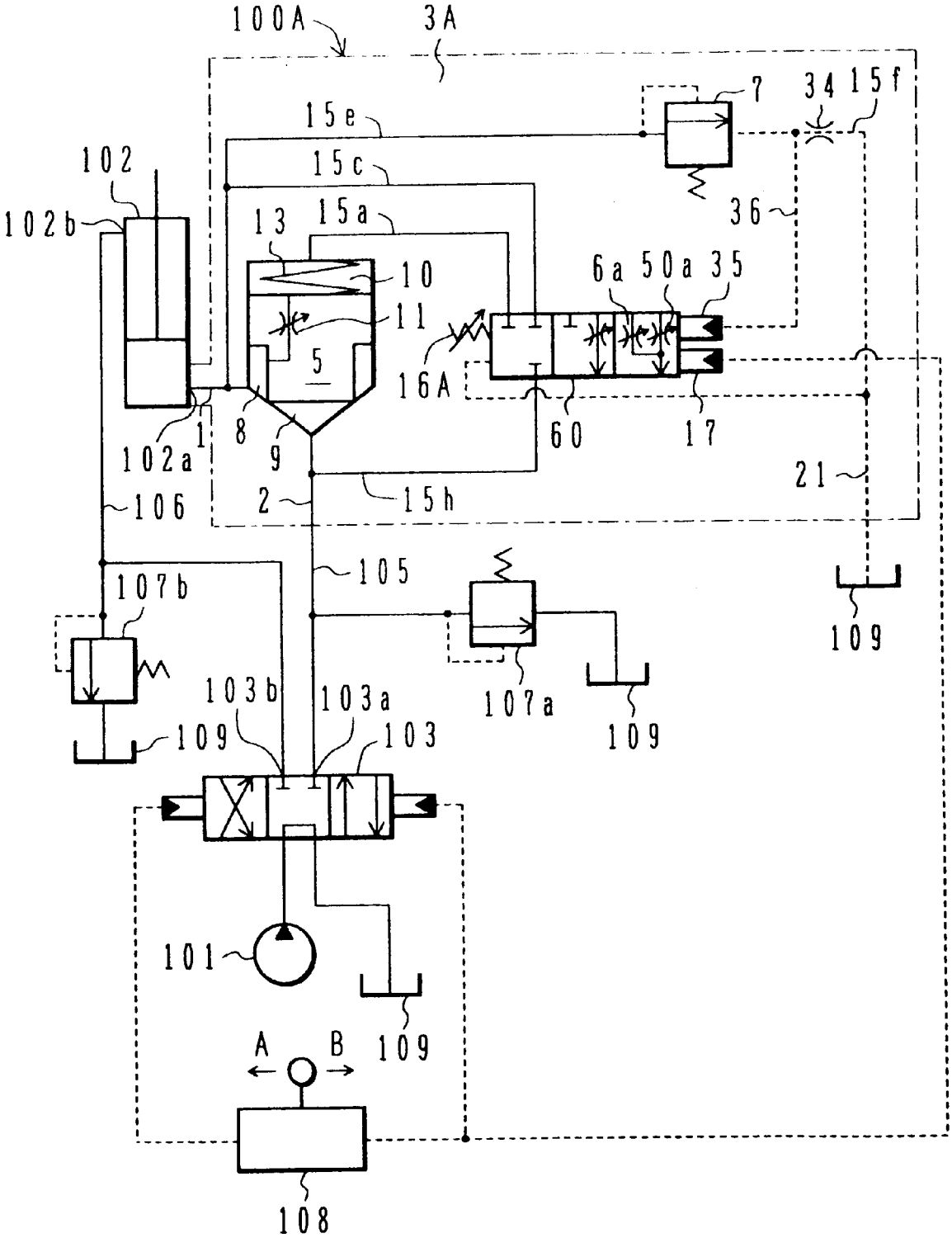
FIG. 8 is a hydraulic circuit diagram showing a hose rupture control valve unit according to a second embodiment of the present invention, along with a hydraulic drive system in which the valve unit is disposed.
Figure 9:
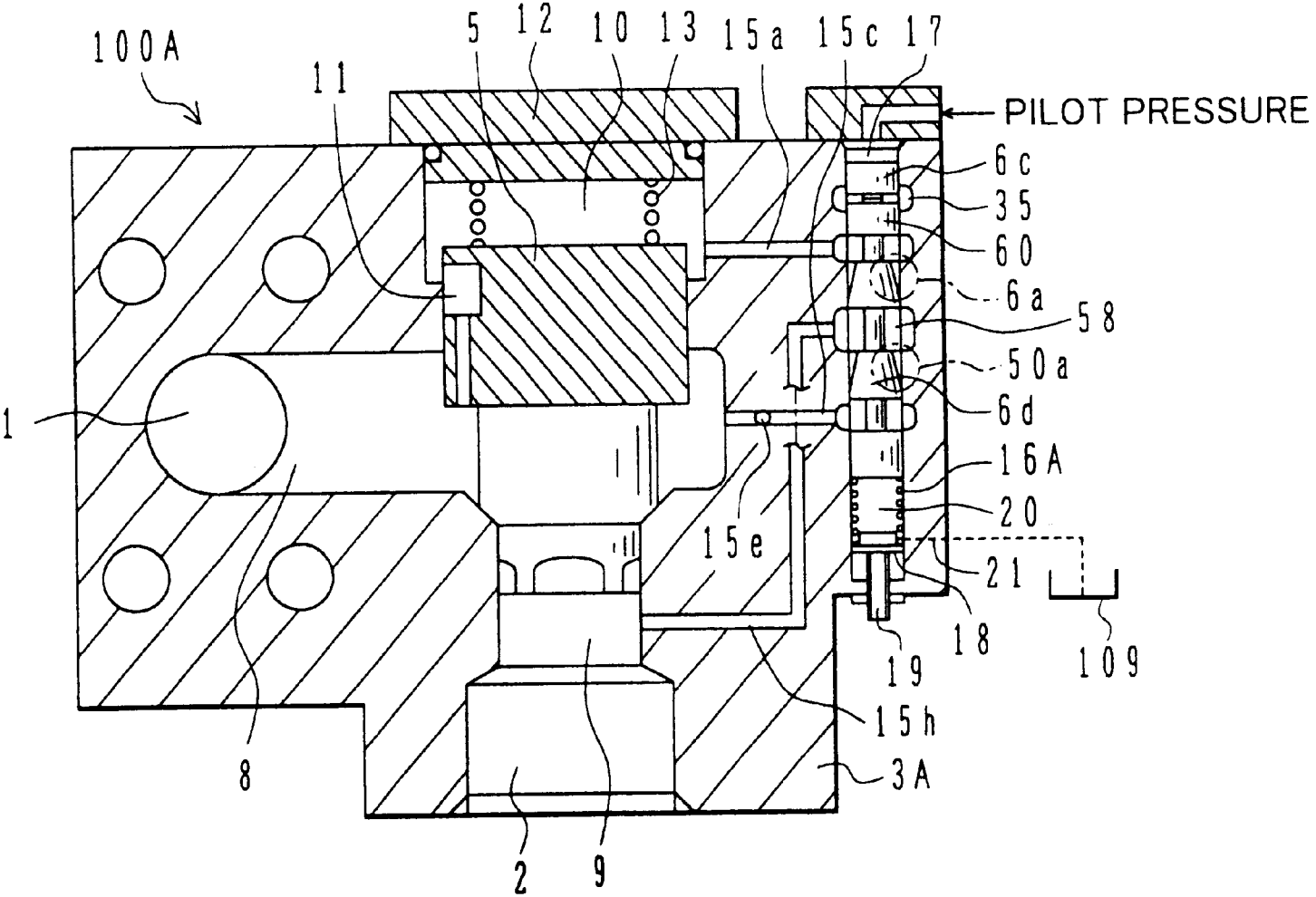
FIG. 9 is a sectional view showing the structure of a portion, i.e., a poppet valve body and a spool valve body, of the hose rupture control valve unit shown in FIG. 8.

Referring to FIGS. 8 and 9, numeral 100A denotes a hose rupture valve unit of this embodiment. Within a housing 3A of the valve unit 100A, there is disposed a single spool valve body 60 that is operated with the pilot pressure supplied from the manual pilot valve 108 as an external signal. This spool valve body 60 serves as both of the first spool valve body 6 and the second spool valve body 50 in the first embodiment.

More specifically, the spool valve body 60 is divided into a piston section 6*c* and a main spool section 6*d*. The main spool section 6*d* includes a pilot variable throttle portion 6*a* comprising a plurality of notches and being able to communicate the pilot passage 15*a* and a pilot/sub-passage 15*h* with each other, and a sub-variable throttle portion 50*a* comprising a plurality of notches and being able to communicate the sub-passage 15*c* and the pilot/sub-passage 15*h* with each other. A common outlet port 58, to which the pilot/sub-passage 15*h* is connected, is provided between the pilot variable throttle portion 6*a* and the sub-variable throttle portion 50*a*. Further, a spring 16A for setting an initial valve-opening force of the pilot variable throttle portion 6*a* and the sub-variable throttle portion 50*a* is disposed at an operating end of the main spool section 6*d* in the valve-closing direction, and a pressure bearing chamber 17, to which the pilot pressure is introduced as an external signal, is formed at an operating end of the piston section 6*c* in the valve-opening direction._@The shift amount of the spool valve body 60 is determined by a control force given by the pilot pressure (external signal) introduced to the pressure bearing chamber 17 and an urging force produced by the spring 16A. Depending on the shift amount of the spool valve body 60, the opening area of each of the pilot variable throttle portion 6*a* and the sub-variable throttle portion 50*a* is changed to selectively cut off and control a pilot flow rate passing through the pilot passage 15*a* and the pilot/sub-passage 15*h* and a sub-flow rate passing through the sub-passage 15*c* and the pilot/sub-passage 15*h*. In addition, a pressure bearing chamber 35 is formed in an area where the main spool section 6*d* and the piston section 6*c* are adjacent to each other. When the small relief valve 7 is operated, the pressure produced by the throttle 34 is introduced to the pressure bearing chamber 35 and then contributes to the overload relief function.

In this embodiment, flow control characteristics of the pilot variable throttle portion 6*a*, the poppet valve body 5 and the sub-variable throttle portion 50*a* are the same as those in the first embodiment shown in FIG. 5. Specifically, the sub-variable throttle portion 50*a* is given with the function of flow rate control in the fine operation range by setting the opening timing such that the sub-variable throttle portion 50*a* is opened at earlier timing than the pilot variable throttle portion 6*a*.

The other construction of the valve unit 100A is essentially the same as that of the valve unit 100 of the first embodiment.

This embodiment having the above-described construction can also provide the advantages as follows. The opening timing of the poppet valve body 5 can be adjusted regardless of the flow rate control in the fine operation range by adjusting the notch size of each of the pilot variable throttle portion 6*a*and the sub-variable throttle portion 5*a*, the notch position thereof, and the strength of the spring 16A. Therefore, the flow control characteristic in the fine operation range and the flow control characteristic of the poppet valve body 5 can be set individually and the overall range of the flow rate control is hardly changed even with change of the flow control characteristic in the fine operation range. As a result, smooth flow control characteristics can be achieved even when the characteristic line of the flow rate control is modified to have a smaller gradient for improving the operability in the fine operation range. Also, since a more variety of flow control characteristics can be set, flexibility in design is increased and the valve unit can be applied to various actuators (hydraulic cylinders) having different demanded flow control characteristics.

Further, in this embodiment, since the pilot variable throttle portion 6*a* and the sub-variable throttle portion 50*a* are provided on the same spool valve body 60, an additional advantage is obtained in that the number of parts and the size of the valve unit are reduced as compared with those in the first embodiment.

A third embodiment of the present invention will be described with reference to FIGS. 10 to 12. In these drawings, identical members to those in FIGS. 1, 2, 8 and 9 are denoted by the same numerals.

Figure 10:
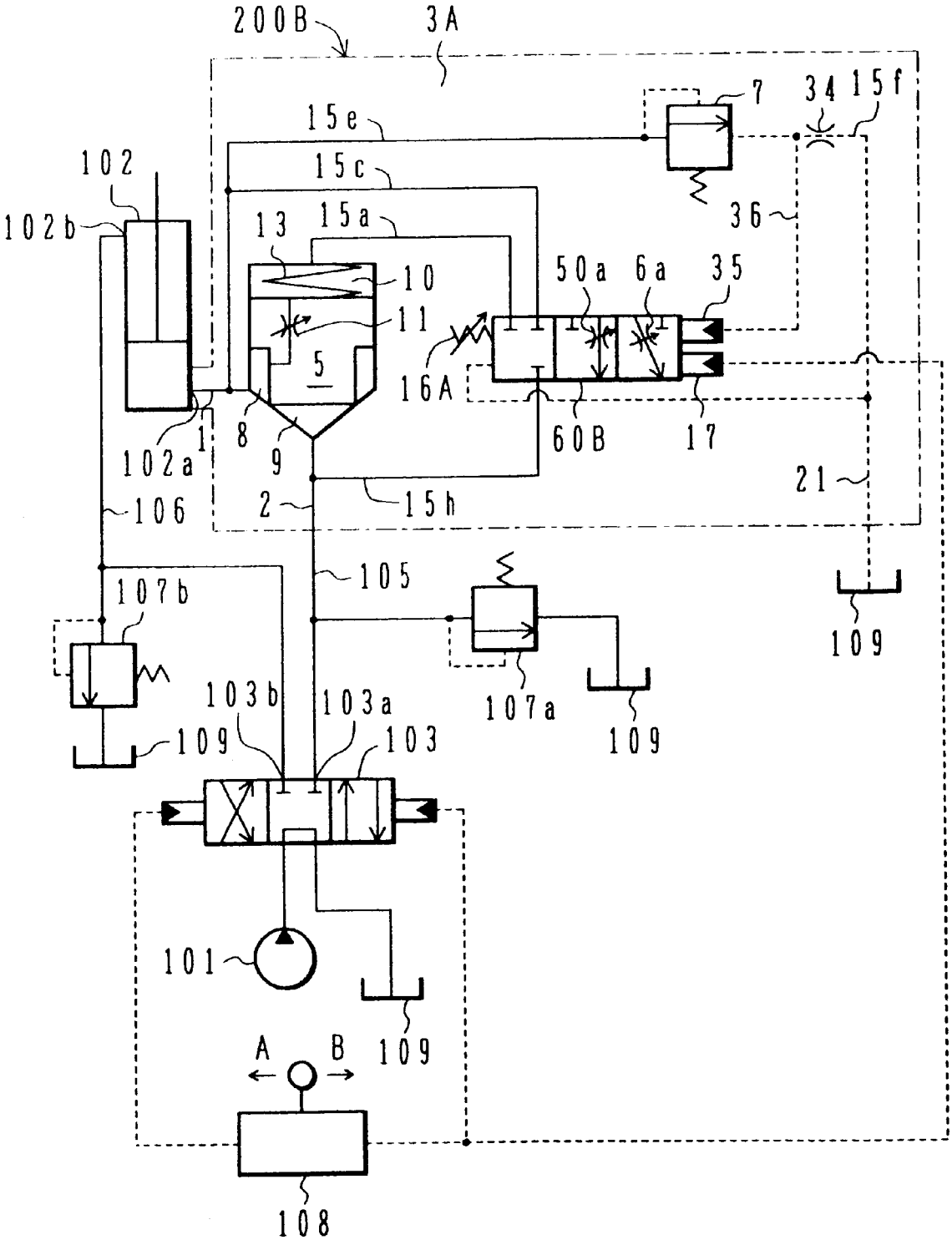
FIG. 10 is a hydraulic circuit diagram showing a hose rupture control valve unit according to a third embodiment of the present invention, along with a hydraulic drive system in which the valve unit is disposed.
Figure 11:
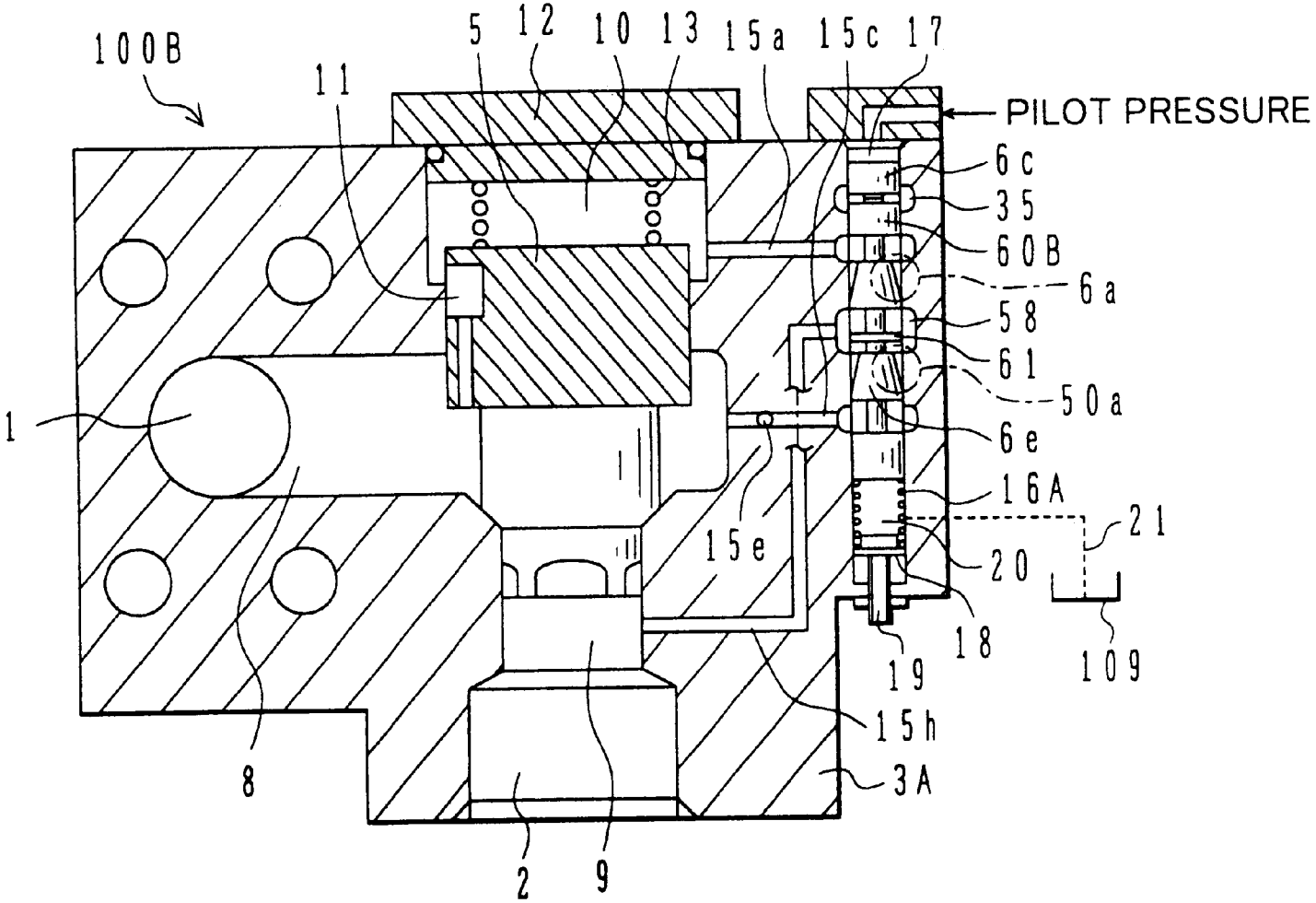
FIG. 11 is a sectional view showing the structure of a portion, i.e., a poppet valve body and a spool valve body, of the hose rupture control valve unit shown in FIG. 10.

Referring to FIGS. 10 and 11, numeral 100B denotes a hose rupture valve unit of this embodiment. Within a housing 3A of the valve unit 10B, there is disposed a single spool valve body 60B that is operated with the pilot pressure supplied from the manual pilot valve 108 as an external signal. As with the spool valve body 60, this spool valve body 60B also serves as both of the first spool valve body 6 and the second spool valve body 50 in the first embodiment.

More specifically, the spool valve body 60B in this embodiment is divided into a piston section 6*c* and a main spool section 6*e*. The main spool section 6*e* includes a pilot variable throttle portion 6*a* comprising a plurality of notches and being able to communicate the pilot passage 15*a* and the pilot/sub-passage 15*h* with each other, and a sub-variable throttle portion 50*a* comprising a plurality of notches and being able to communicate the sub-passage 15*c* and the pilot/sub-passage 15*h* with each other. Further, the main spool section 6*e* includes a land portion 61 provided on the outlet side of the sub-variable throttle portion 50*a*. The land portion 61 functions as a means for cutting off the sub-passage. When the main spool section 6*e* is in the inoperative position (neutral position) as shown, the land portion 61 is positioned in an outlet port 58 to which the pilot/sub-passage 15*h* is connected. When the main spool section 6*e* is shifted a predetermined distance in the valve-opening direction (downward as viewed in the drawing) with the pilot pressure supplied as an external signal, the land portion 61 fits into a spool bore of the housing 3A, thereby closing a flow passage of the sub-variable throttle portion 50*a* on the side of the outlet port 58. Herein, the predetermined distance necessary for the land 61 to close the flow passage of the sub-variable throttle portion 50*a* means a stroke distance of the main spool section 6*e* after the main spool section 6*e* has shifted to open the pilot variable throttle portion 6*a* and hence to open the poppet valve body 5.

Figure 12:
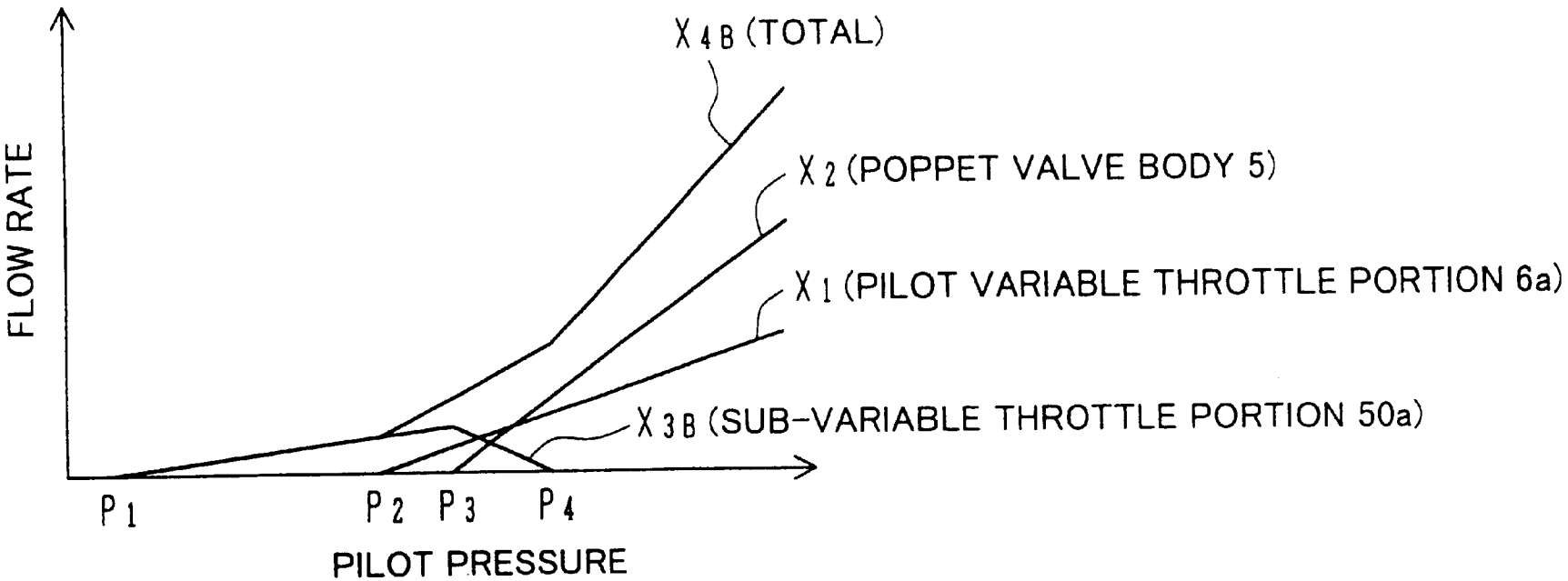
FIG. 12 is a graph showing the relationships of a characteristic of flow rate passing through a pilot variable throttle portion (pilot flow rate), a characteristic of flow rate passing through the poppet valve body (main flow rate), a characteristic of flow rate passing through a sub-variable throttle portion (sub-flow rate), and a characteristic of total flow rate with respect to a pilot pressure in the hose rupture control valve unit shown in FIG. 10.

FIG. 12 shows the relationships of a characteristic (X1) of flow rate passing through the pilot variable throttle portion 6*a* (pilot flow rate), a characteristic (X2) of flow rate passing through the poppet valve body 5 (main flow rate), a characteristic (X3B) of flow rate passing through the sub-variable throttle portion (sub-flow rate), and a characteristic (X4) of total flow rate with respect to the pilot pressure supplied as an external signal.

In FIG. 12, when the pilot pressure reaches $P_1$, the sub-variable throttle portion 50*a* starts opening and the opening area of the sub-variable throttle portion 50*a* increases as the pilot pressure rises over $P_1$. Correspondingly, the rate of fluid flow passing through the sub-variable throttle portion 50*a*, i.e., the sub-flow rate passing through the sub-passage 15*c* and the pilot/sub-passage 15*h*, also increases.

When the pilot pressure reaches $P_{21}$, the pilot variable throttle portion 6*a* now starts opening and the opening area of the pilot variable throttle portion 6*a* increases as the pilot pressure rises over $P_2$. Correspondingly, the rate of fluid flow passing through the pilot variable throttle portion 6*a*, i.e., the pilot flow rate passing through the pilot passage 15*a* and the pilot/sub-passage 15*h*, also increase.

When the pilot pressure further rises and reaches $P_3$, the poppet valve body 5 starts opening and the opening area of the poppet valve body 5 increases as the pilot pressure rises over $P_3$. Correspondingly, the rate of fluid flow passing through the poppet valve body 5, i.e., the main flow rate, also increases.

Characteristics of the pilot flow rate and the main flow rate are the same as those in the first and second embodiments. In this third embodiment, the land portion 51 is provided on the outlet side of the sub-variable throttle portion 50*a* of the spool valve body 60B, and when the pilot pressure reaches a level near $P_3$, the land portion 61 starts closing the flow passage of the sub-variable throttle portion 50*a* on the side of the outlet port 58. Then, the land portion 61 reduces the opening area of that flow passage as the pilot pressure rises over $P_3$, and completely cuts off that flow passage when the pilot pressure reaches $P_4$. Therefore, the rate of fluid flow passing through the sub-variable throttle portion 50*a*, i.e., the sub-flow rate, starts reducing when the pilot pressure reaches a level near $P_3$, then decreases as the pilot pressure rises over $P_3$, and finally becomes 0 when the pilot pressure reaches $P_4$.

With this embodiment having the above-described construction, since the pilot variable throttle portion 6*a* and the sub-variable throttle portion 50*a* are provided on the same spool valve body 60B, a similar advantage as that in the second embodiment is obtained.

Further, this embodiment provides the following advantage because the land portion 51 functioning as a means for cutting off the sub-passage is provided on the spool valve body 60B.

In the construction wherein the sub-passages and the sub-variable throttle portion 50*a* are provided in addition to the pilot passages and the pilot variable throttle portion 6*a* as with the first and second embodiments, the pilot flow rate and the sub-flow rate join with each other on the side of the hose connecting chamber, e.g., in the passage 15*b*2 in the first embodiment and at the outlet port 58 in the second embodiment. Therefore, the flow rate increases in a joining area and the downstream side thereof, and a pressure loss generated in the subsequent flow passage increases correspondingly. Also, in the joining area of the pilot flow rate and the sub-flow rate, a jet stream occurs due to collision of two flows. Such an increase of the passage pressure loss and a jet stream occurred in the joining area increases or fluctuates the pressure in the back pressure chamber 10, thus resulting in a possibility that the poppet valve body 5 may not be opened to have an opening area as per instructed by an external signal and the control of the main flow rate may be adversely affected.

In this embodiment, since the sub-passage is cut off by the land portion 61 after opening of the poppet valve body 5 as described above, only the pilot flow passes through the joining area after the sub-passage has been cut off. It is therefore possible to suppress an increase of the passage pressure loss and the occurrence of a jet stream due to joining of the pilot flow rate and the sub-flow rate, to reduce an influence upon the control of the main flow rate, and to realize smooth control of the main flow rate. Also, because of a reduction in pressure loss, a joining passage can be narrowed and the size of the valve unit can be further reduced. Moreover, since the land 61 is just additionally formed on the spool valve body 60B (main main spool section 6*e*), the sub-passage can be cut off with a simple construction.

Figure 13:
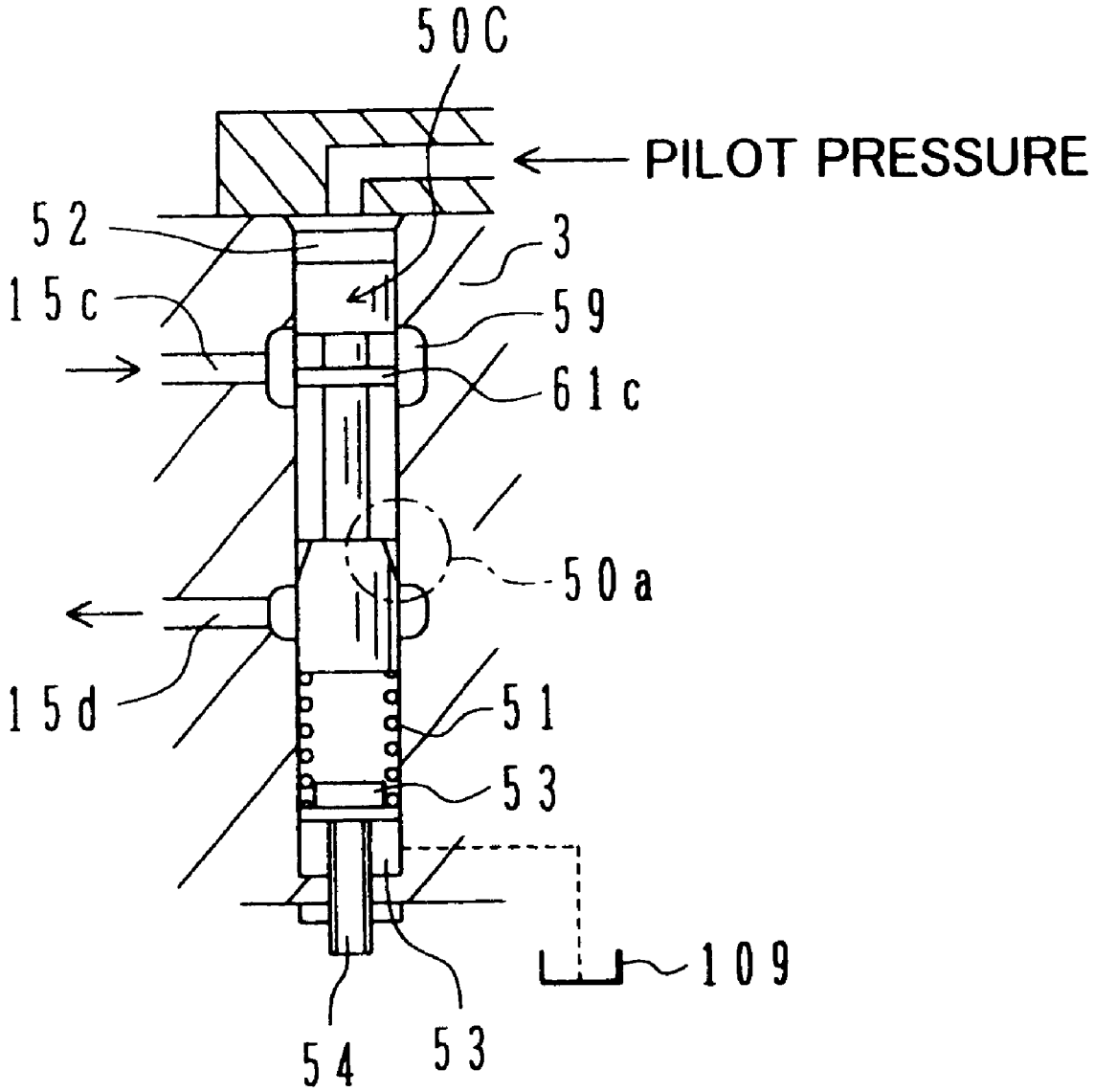
FIG. 13 is a sectional view of principal part of a hose rupture control valve unit according to a fourth embodiment of the present invention.
Figure 14:
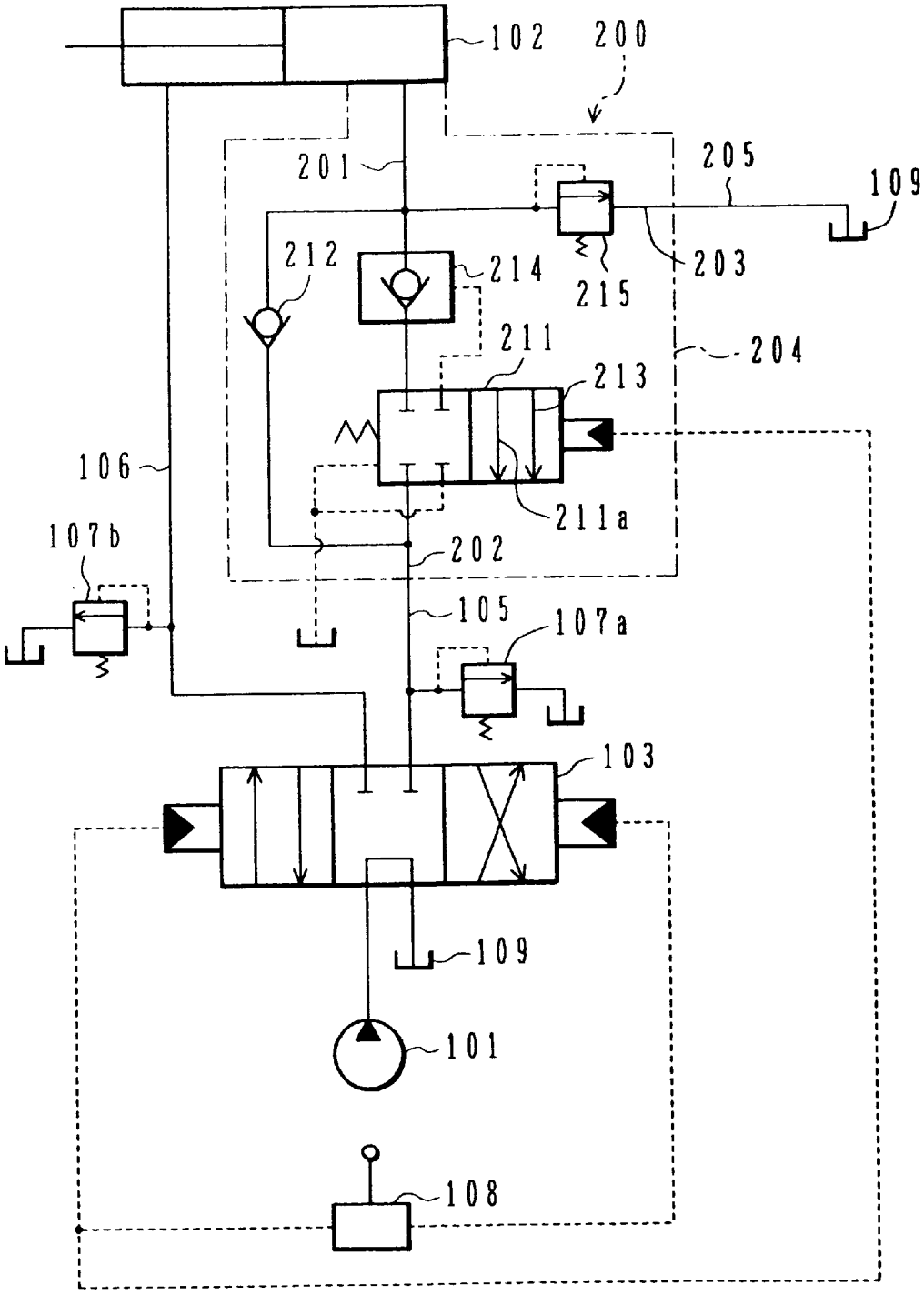
FIG. 14 is a hydraulic circuit diagram showing a conventional hose rupture control valve unit, along with a hydraulic drive system in which the valve unit is disposed.
Figure 15:
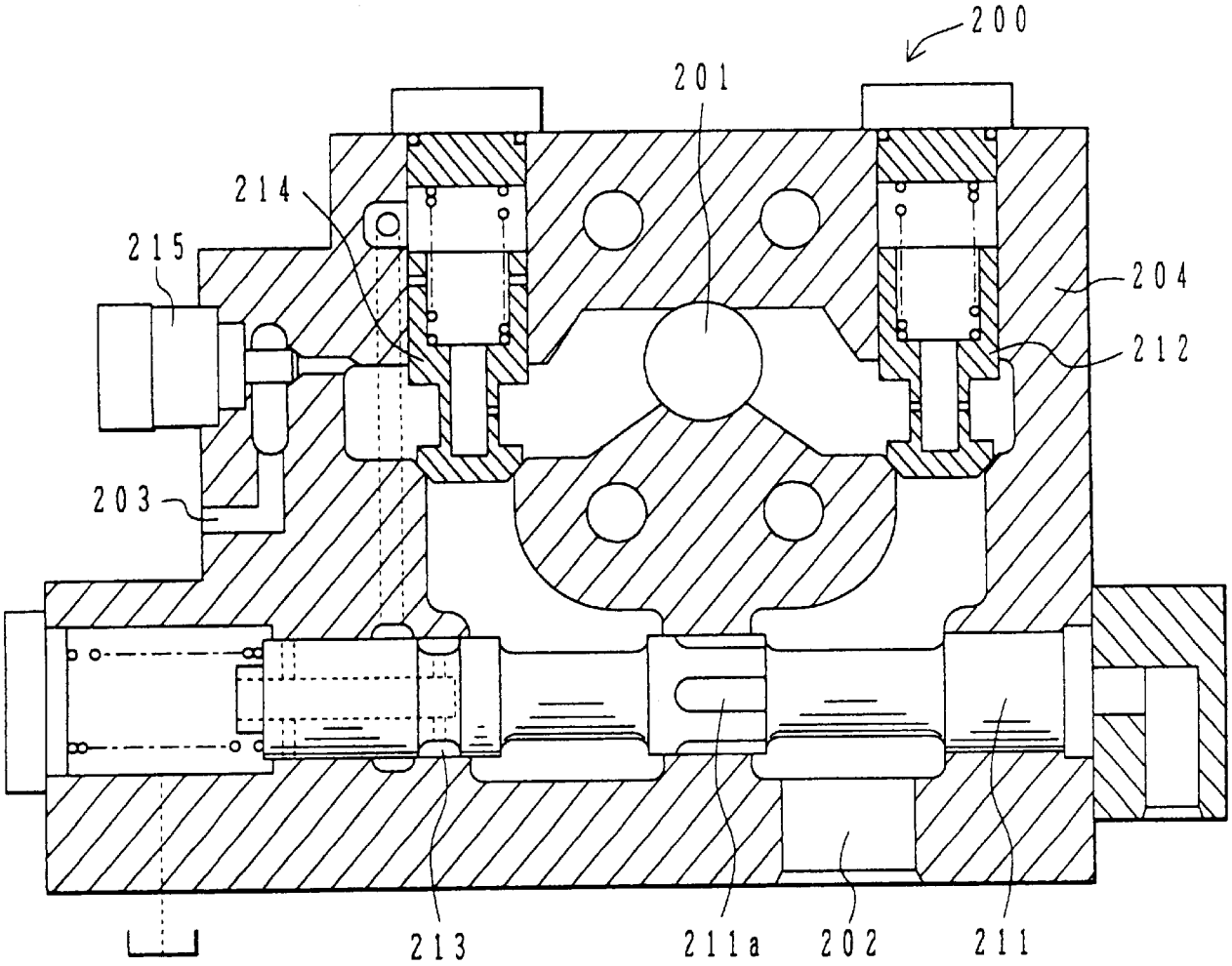
FIG. 15 is a sectional view showing the structure of a portion, i.e., a poppet valve body and a spool valve body, of the hose rupture control valve unit shown in FIG. 14.
Figure 16:
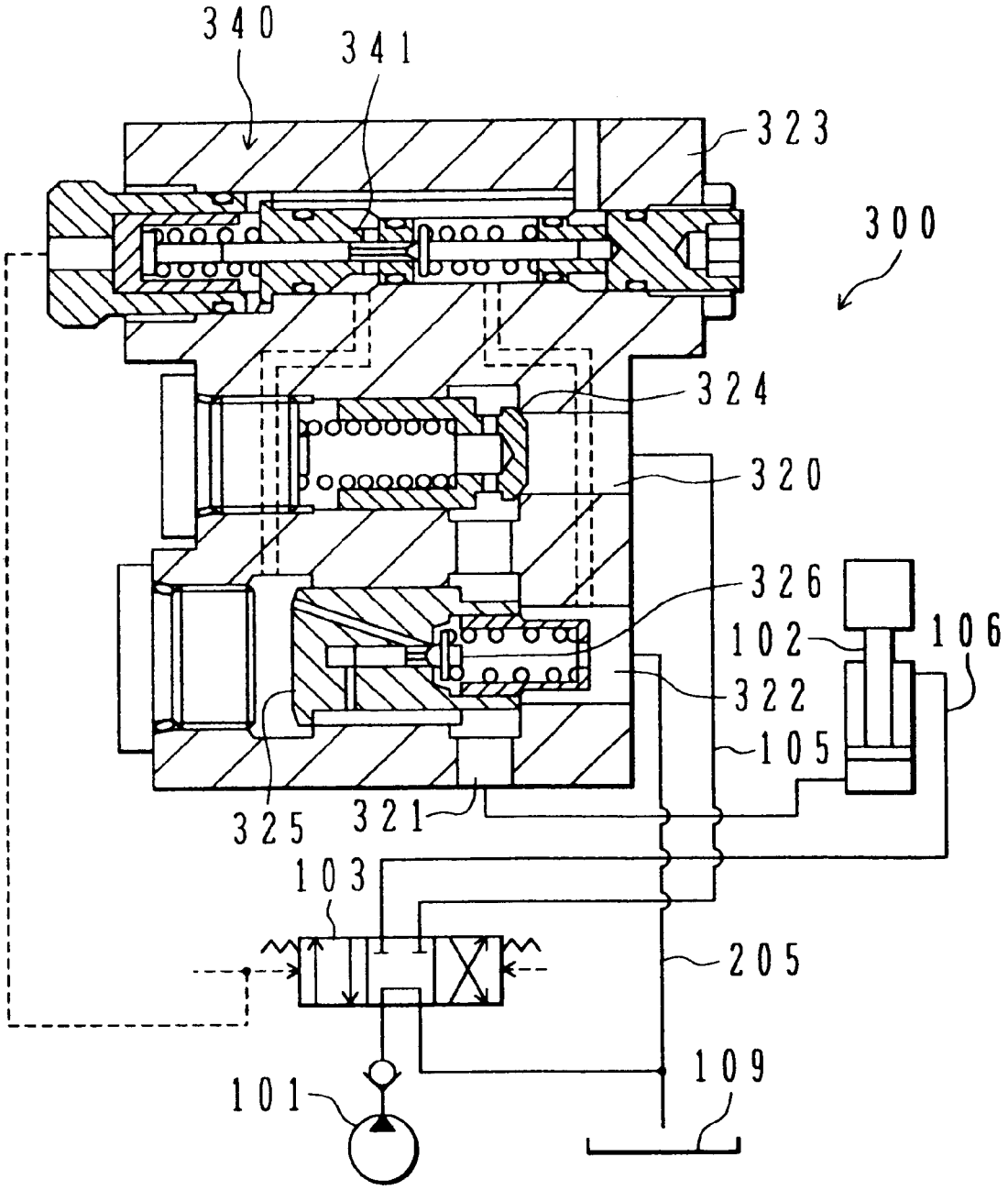
FIG. 16 illustrates an opening area of the poppet valve body and an opening area of a feedback slit with respect to the shift amount (stroke) of the poppet valve body in the conventional hose rupture control valve unit.

The above-described third embodiment is constructed by modifying the second embodiment, in which the pilot variable throttle portion and the sub-variable throttle portion are provided on a single pilot valve body, such that a means for cutting off the flow passage of the sub-variable throttle portion is provided on the single pilot valve body. However, a similar modification can also be added to the first embodiment wherein the pilot variable throttle portion and the sub-variable throttle portion are provided on separate pilot valve bodies. FIG. 13 is an enlarged view of a portion including a second spool valve body in the case where such a modification is added to the first embodiment.

Referring to FIG. 13, a land portion 61C is provided on a second spool valve body 50C at a position locating on the inlet side of a sub-variable throttle portion 50*a* thereof and corresponding to an inlet port 59 to which the sub-passage 15*c* is connected. When the second spool valve body 50C is in the inoperative position (neutral position) as shown, the land portion 61C is positioned in the inlet port 59. When the second spool valve body 50C is shifted a predetermined distance in the valve-opening direction (downward as viewed in the drawing) with the pilot pressure supplied as an external signal and the poppet valve body 5 (see FIG. 1) is opened, the land portion 61C fits into a spool bore of the housing 3, thereby closing a flow passage of the sub-variable throttle portion 50*a* on the side of the inlet port 59.

This embodiment having the above-described construction can provide the following advantages in addition to similar advantages as obtained in the first embodiment. Since the sub-passage is cut off by the land portion 61C after opening of the poppet valve body, only the pilot flow passes through a joining area after the sub-passage has been cut off. It is therefore possible to suppress an increase of the passage pressure loss and the occurrence of a jet stream due to joining of the pilot flow rate and the sub-flow rate, to reduce an influence upon the control of the main flow rate, and to realize smooth control of the main flow rate. Also, because of a reduction in pressure loss, a joining passage (passage 15*b* shown in FIG. 1) can be narrowed and the size of the valve unit can be further reduced.

Industrial Applicability

According to the present invention, in a hose rupture control valve unit, a pressure loss can be reduce and an overall size and production cost of the valve unit can be cut down while ensuring various functions that are the least necessary as a hose rupture control valve unit. Also, just by providing the second variable throttle portion in the sub-passage, smooth flow control characteristics are obtained and a more variety of flow control characteristics can be set. As a result, flexibility in design is increased and the valve unit can be applied to various actuators (hydraulic cylinders).

Furthermore, according to the present invention, by providing a means for cutting off the sub-passage, an effect upon the poppet shift amount due to a pressure loss in the joining passage and a jet stream occurred in the joining area can be reduced. It is therefore possible to realize smooth control of the main flow rate with good accuracy, to narrow the joining passage, and to further reduce the size of the valve unit.

What is claimed is:

1. A hose rupture control valve unit (100; 100A; 100B) provided between a supply/drain port (102*a*) of a hydraulic cylinder (102) and a hydraulic hose (105) for controlling a flow rate of a hydraulic fluid coming out from said supply/drain port to said hydraulic hose in accordance with an external signal, wherein said valve unit comprises:

a poppet valve body (5) serving as a main valve slidably disposed in a housing (3) provided with a cylinder connecting chamber (8) connected to said supply/drain port (102*a*), a hose connecting chamber (9) connected to said hydraulic hose (105), and a back pressure chamber (10), said poppet valve body being able to selectively cut off and establish communication between said cylinder connecting chamber and said hose connecting chamber, and changing an opening area depending on the shift amount thereof;

a feedback variable throttle passage (11) provided in said poppet valve body, having an initial opening area when said poppet valve body is in a cutoff position, and increasing an opening area thereof depending on the shift amount of said poppet valve body;

a first variable throttle portion (6*a*) disposed in a pilot passage (15*a*, 15*b*; 15*a*, 15*h*) connecting said back pressure chamber and said hose connecting chamber, and operated in accordance with the external signal to cut off and control a rate of pilot flow flowing from said cylinder connecting chamber to said hose connecting chamber through said feedback variable throttle passage, said back pressure chamber and said pilot passage; and a second variable throttle portion (50*a*) disposed in a sub-passage (15*c*, 15*d*; 15*c*, 15*h*) connecting said cylinder connecting chamber and said hose connecting chamber, and operated in accordance with the external signal to cut off and control a rate of sub-flow passing through said sub-passage.

2. A hose rupture control valve unit according to claim 1, wherein opening timings of said first and second variable throttle portions are set such that said second variable throttle portion (50*a*) is opened earlier than said first variable throttle portion (6*a*) in accordance with the external signal.

3. A hose rupture control valve unit according to claim 1, wherein said first variable throttle portion (6*a*) and said second variable throttle portion (50*a*) are provided on separate spool valve bodies (6,50).

4. A hose rupture control valve unit according to claim 1, wherein said first variable throttle portion (6*a*) and said second variable throttle portion (50*a*) are provided on the same spool valve body (60; 60B).

5. A hose rupture control valve unit according to claim 1, further comprising means (61) for cutting off said sub-passage (15*c*, 15*h*) after opening said poppet valve (5).

6. A hose rupture control valve unit according to claim 5, wherein said means (61) for cutting off said sub-passage (15*c*, 15*h*) is a land portion (61) provided on a spool valve body (60B, 6*e*) including said second variable throttle portion (50*a*), said land portion cutting off a flow passage of said second variable throttle portion (50*a*) when said spool valve body is shifted a predetermined distance or more.

* * * * *